US008337058B2

(12) United States Patent
Gordin et al.

(10) Patent No.: US 8,337,058 B2
(45) Date of Patent: Dec. 25, 2012

(54) SINGLE ARM MOGUL MOUNT FOR SPORTS LIGHTING FIXTURES

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 10 days.

(21) Appl. No.: 11/333,996

(22) Filed: Jan. 18, 2006

(65) Prior Publication Data

US 2006/0176708 A1 Aug. 10, 2006

Related U.S. Application Data

(60) Provisional application No. 60/644,687, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,636, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005.

(51) Int. Cl.

| | |
|---|---|
| ***F21V 21/28*** | (2006.01) |
| ***F21V 21/30*** | (2006.01) |
| ***F21V 7/00*** | (2006.01) |
| ***F21S 8/00*** | (2006.01) |

(52) U.S. Cl. ..... 362/427; 362/263; 362/287; 362/350

(58) Field of Classification Search ..... 362/257, 362/350, 263, 269, 275, 277, 282–285, 287, 362/289, 427–428, 371–372, 418–419, 449, 362/421, 429, 430

See application file for complete search history.

(56) References Cited

U.S. PATENT DOCUMENTS

| | | | | |
|---|---|---|---|---|
| 1,438,534 | A * | 12/1922 | Kuen | 362/427 |
| 2,170,882 | A * | 8/1939 | Wideroe | 362/275 |
| 2,193,272 | A * | 3/1940 | Crossley | 362/419 |
| 2,447,923 | A | 8/1948 | Tuck | |
| 2,763,774 | A * | 9/1956 | Beach et al. | 362/419 |
| 4,190,881 | A * | 2/1980 | Drost et al. | 362/249.01 |

(Continued)

FOREIGN PATENT DOCUMENTS

EP 1 172 839 A2 1/2002

*Primary Examiner* — Alan Cariaso

(74) *Attorney, Agent, or Firm* — McKee, Voorhees & Sease, P.L.C.

(57) ABSTRACT

An apparatus and method for a high intensity lighting fixture. One aspect, a knuckle for mounting the light fixture by its bulb cone to a cross arm is attached along the side of the bulb cone. This has various potential advantages including decreased effective projected area, protection of watering to the bulb cone, and decreased moment.

15 Claims, 34 Drawing Sheets

U.S. PATENT DOCUMENTS

| | | | | | |
|---|---|---|---|---|---|
| 4,811,181 | A | * | 3/1989 | Jones | 362/287 |
| 4,816,974 | A | | 3/1989 | Gordin | |
| 4,935,853 | A | * | 6/1990 | Collins | 362/272 |
| 4,947,303 | A | | 8/1990 | Gordin et al. | |
| 5,161,883 | A | * | 11/1992 | Gordin et al. | 362/263 |
| 5,600,537 | A | | 2/1997 | Gordin et al. | |
| 5,651,606 | A | * | 7/1997 | Krogman | 362/96 |
| 5,816,691 | A | | 10/1998 | Gordin et al. | |
| 5,856,721 | A | | 1/1999 | Gordin et al. | |
| 5,964,522 | A | * | 10/1999 | Schaefer et al. | 362/350 |
| 5,988,833 | A | * | 11/1999 | Giese et al. | 362/287 |
| 6,036,338 | A | | 3/2000 | Gordin | |
| 6,203,176 | B1 | | 3/2001 | Gordin | |
| 6,220,726 | B1 | * | 4/2001 | Gordin | 362/247 |
| 6,644,837 | B2 | * | 11/2003 | Borders et al. | 362/399 |
| 6,833,675 | B2 | | 12/2004 | Gordin | |
| 6,942,363 | B1 | * | 9/2005 | LeVasseur | 362/277 |
| 7,232,236 | B2 | * | 6/2007 | Vitense et al. | 362/153 |

* cited by examiner

Front View

Top View

SECTION A–A

Side View

FRONT VIEW

*SIDE VIEW*

SECTION F-F
SHOWN AIMED AT 47° VERTICAL

SECTION A-A

SECTION C-C

Top View

Side View

Bottom View

SECTION A–A

VIEW D–D

VIEW E–E

SECTION C–C

SECTION B-B

SECTION A-A

Front View

Side View

Back View

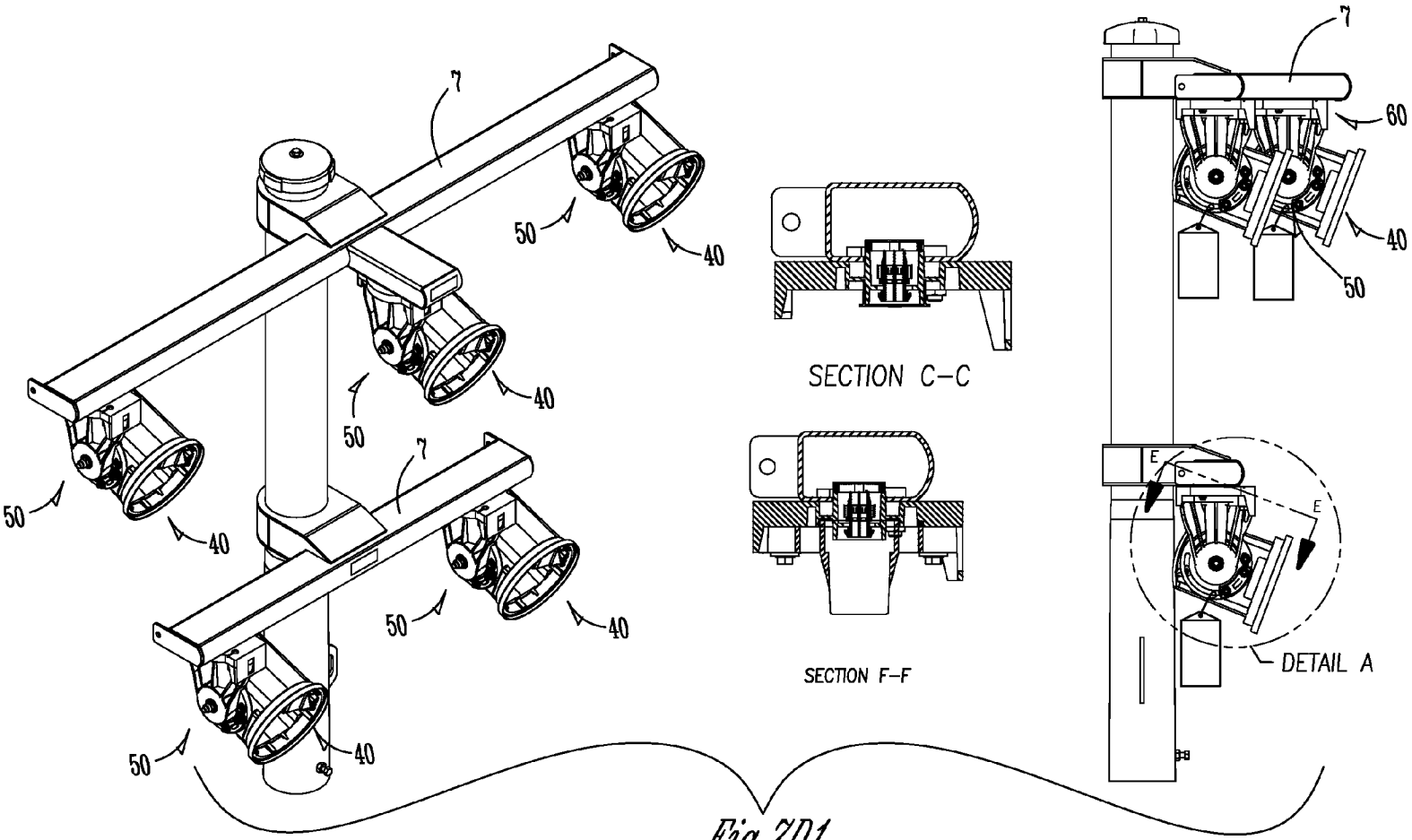
Fig. 7D1

Figure 2A:
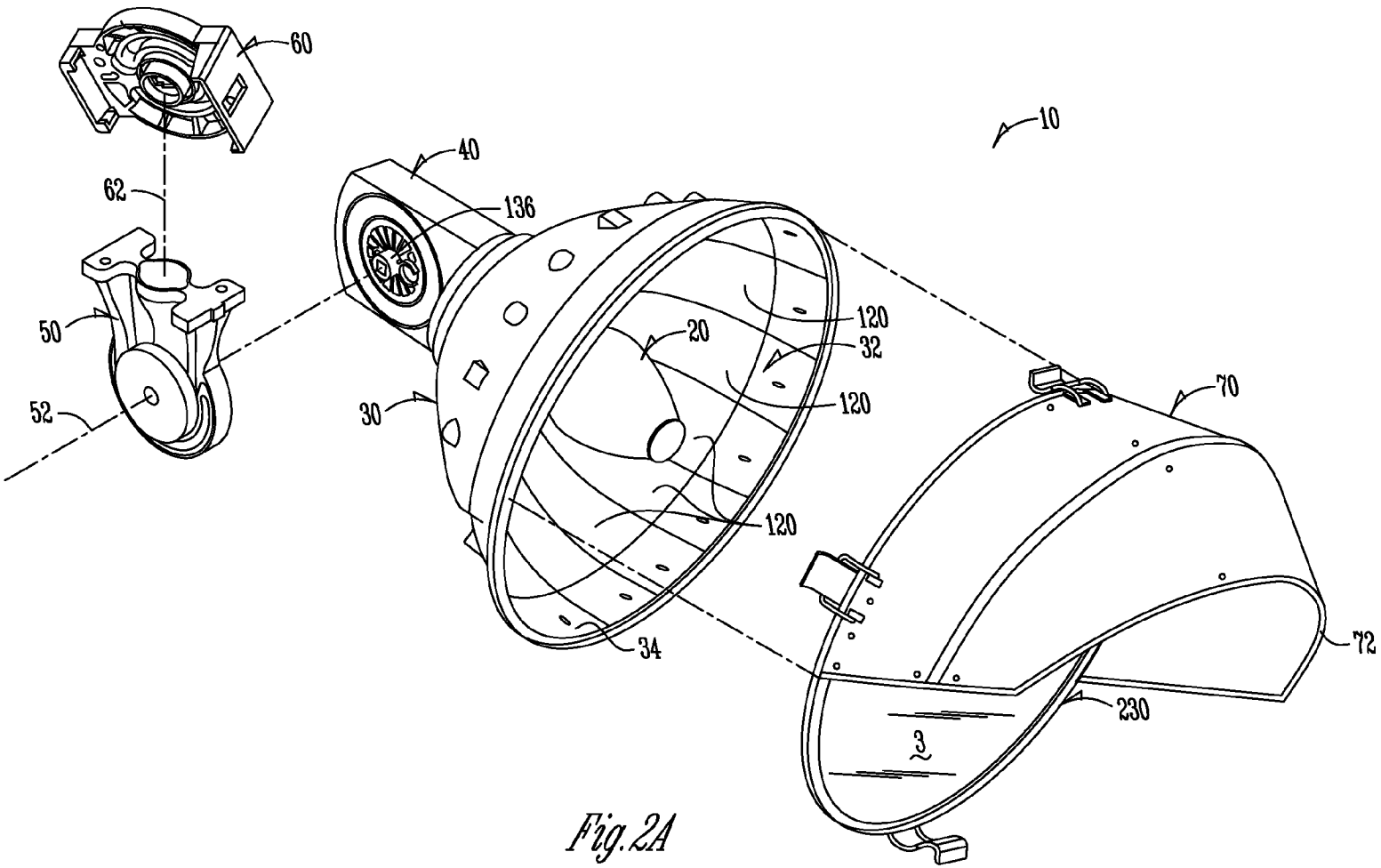
Figure 2B:
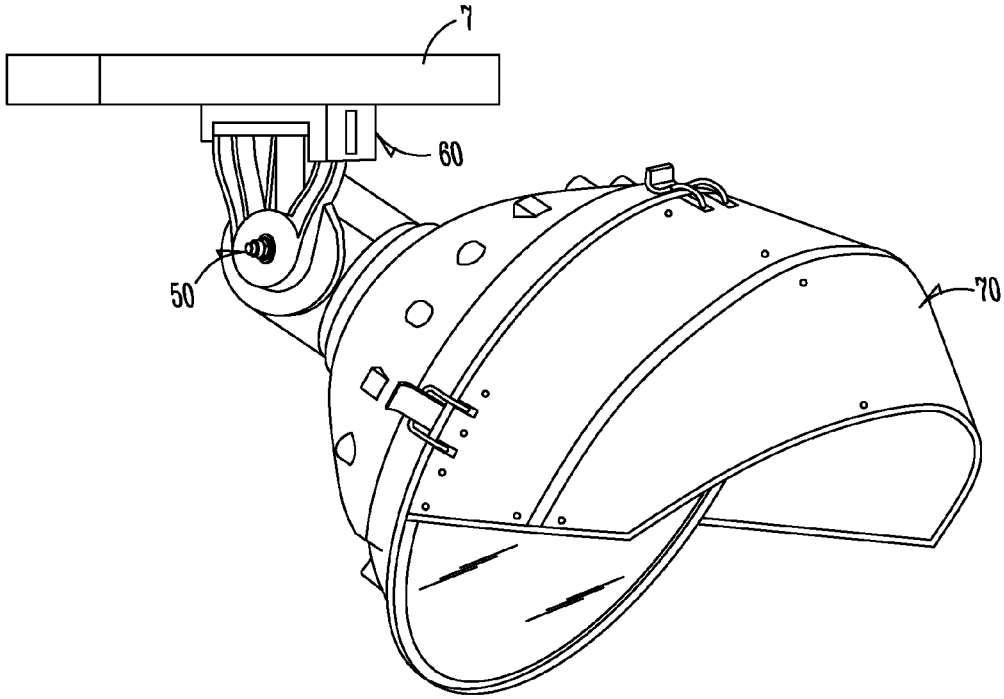
Figure 2C:
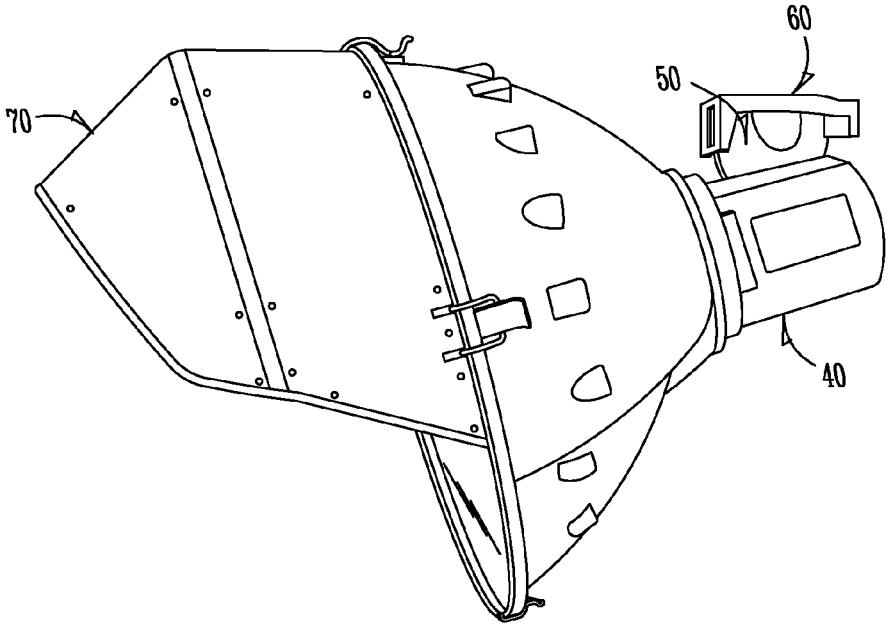

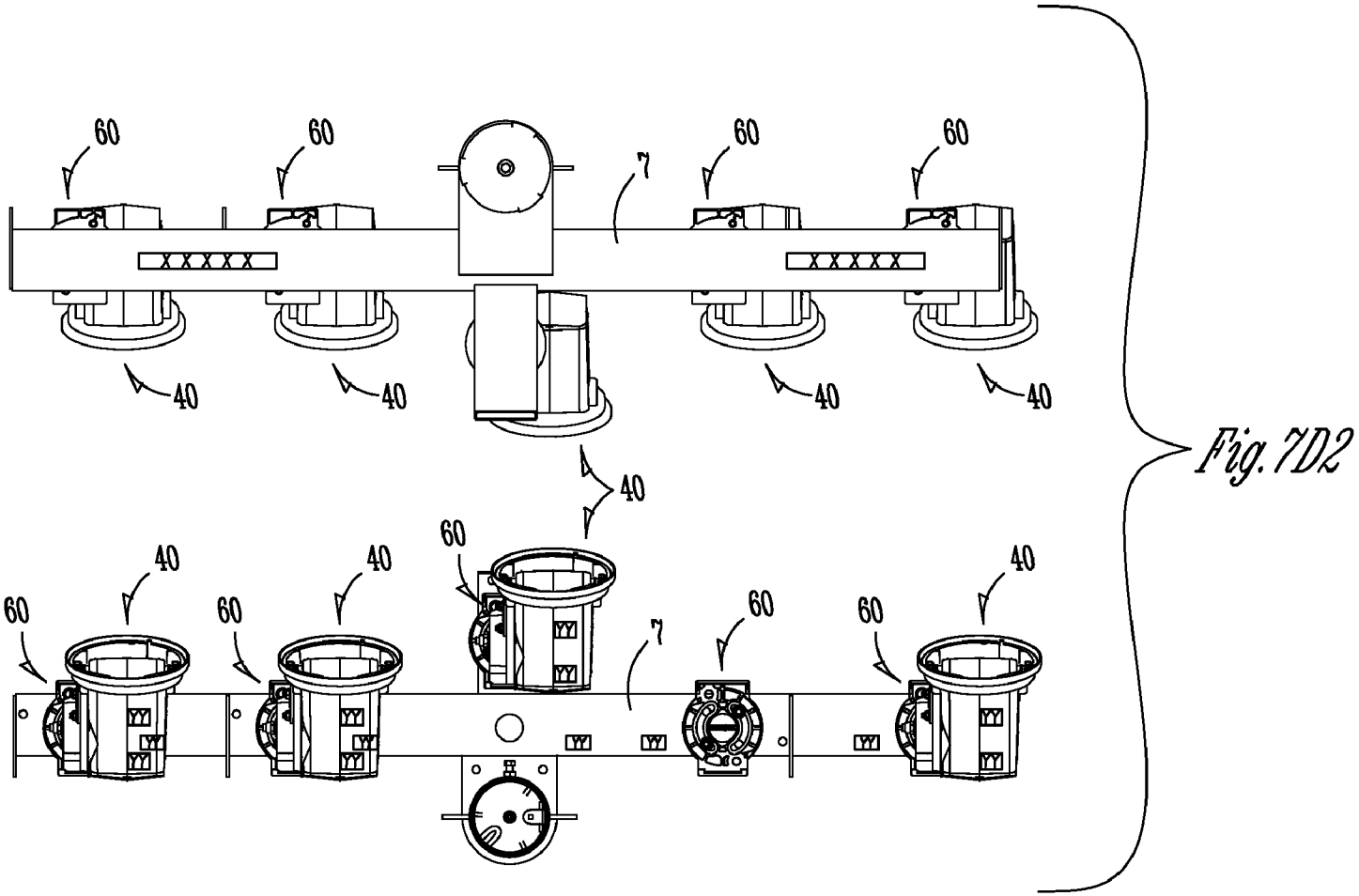
Fig. 7D2

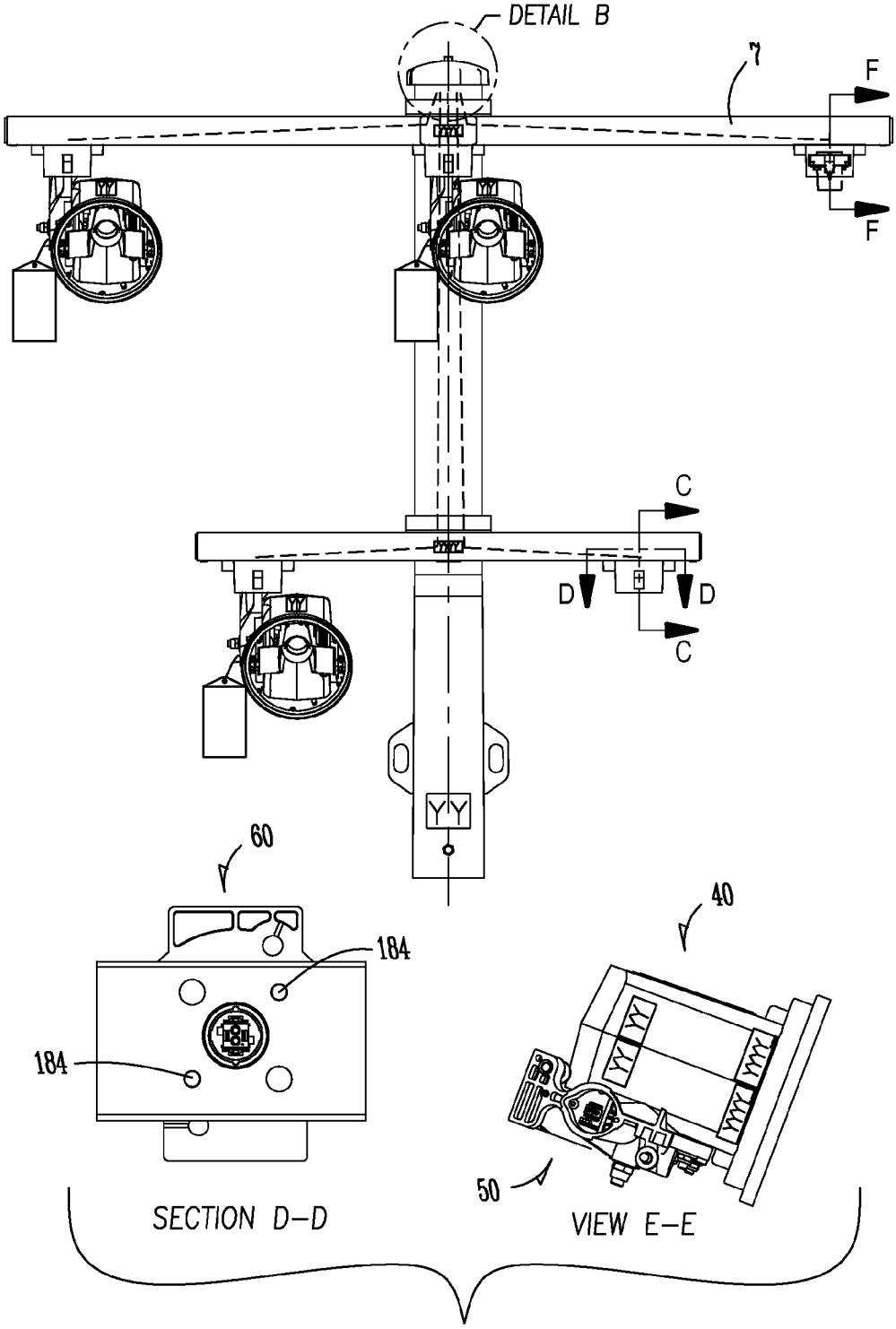
Fig. 7D3

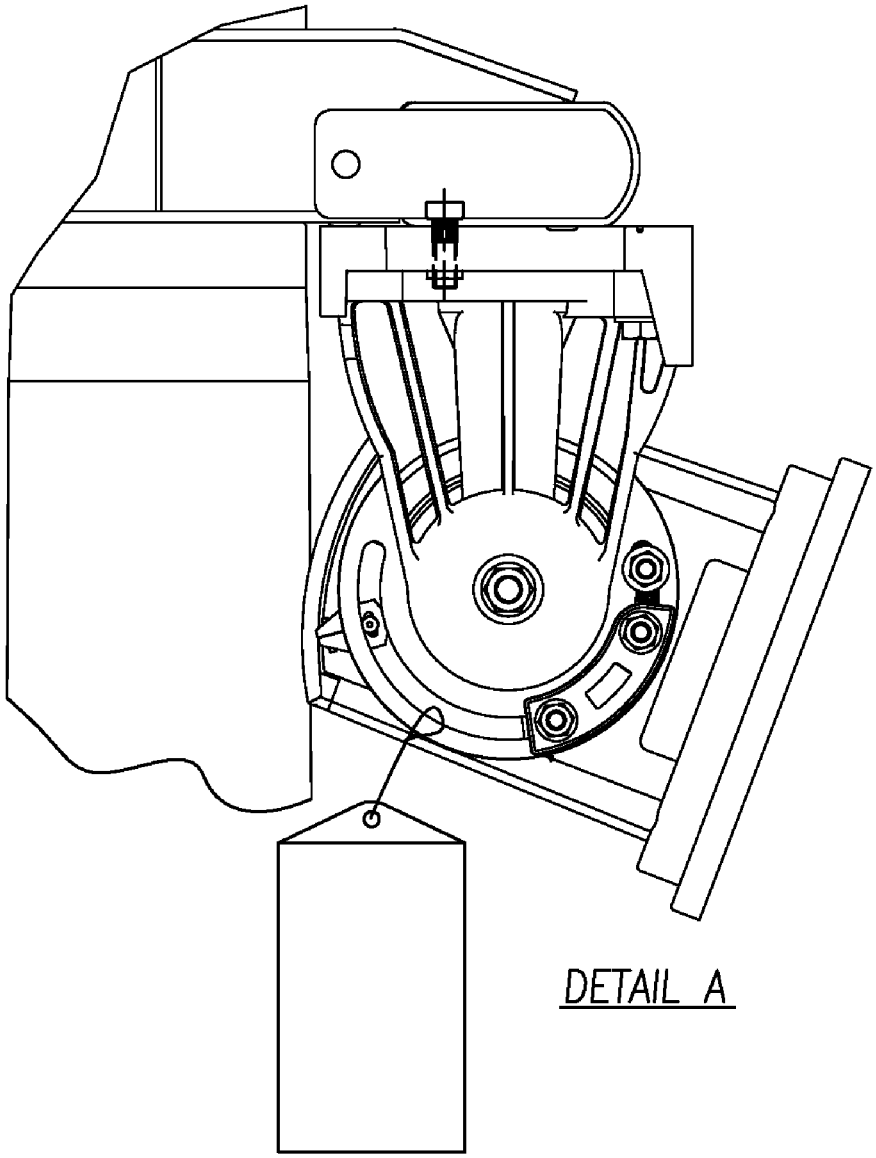
Fig. 7D4

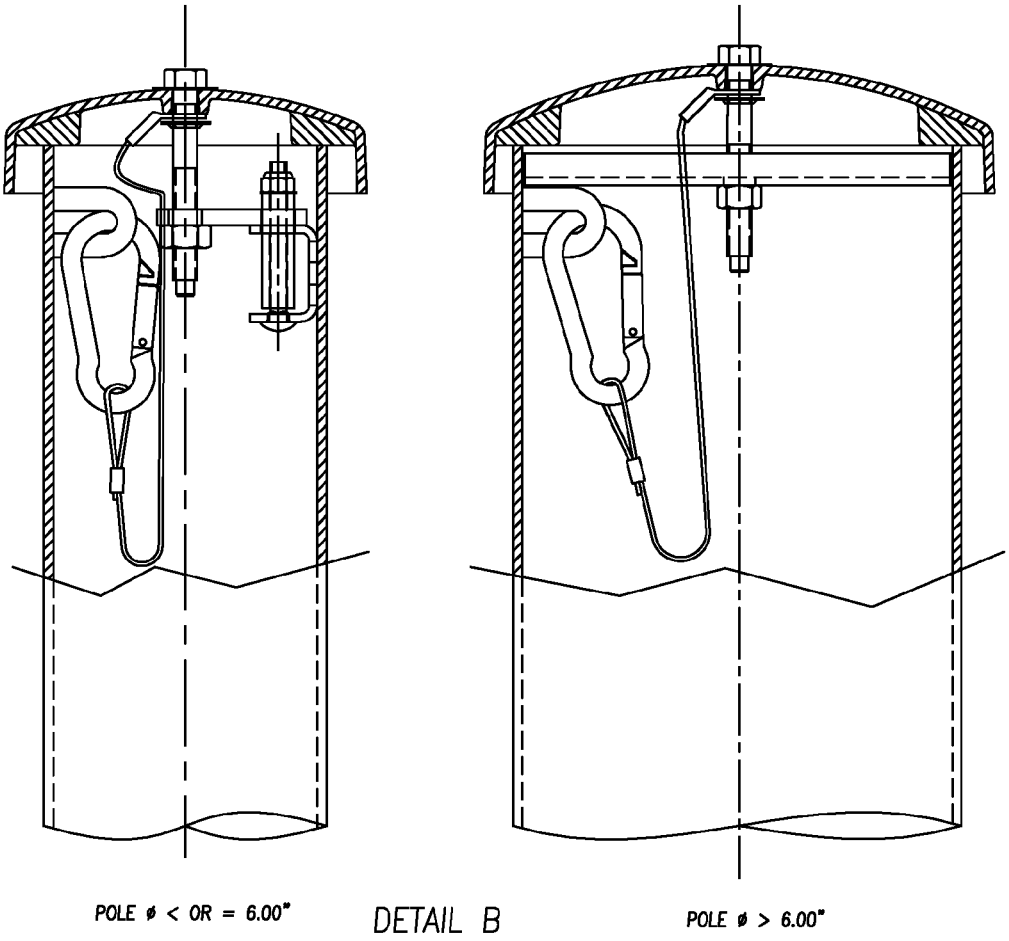
Fig. 7D5

SECTION G–G

SECTION H–H

SECTION J–J

DETAIL K

SECTION B–B

VIEW C–C

DETAIL D

FRONT VIEW

SIDE VIEW

BACK VIEW

SECTION A-A

DETAIL B

SINGLE ARM MOGUL MOUNT FOR SPORTS LIGHTING FIXTURES

CROSS REFERENCE TO RELATED APPLICATIONS

This application claims priority under 35 U.S.C. §119 of a provisional application U.S. Ser. No. 60/644,719 filed Jan. 18, 2005, herein incorporated by reference in its entirety. This application is also a non-provisional of the following provisional U.S. applications, all filed Jan. 18, 2005: U.S. Ser. No. 60/644,639; U.S. Ser. No. 60/644,536; U.S. Ser. No. 60/644,747; U.S. Ser. No. 60/644,534; U.S. Ser. No. 60/644,720; U.S. Ser. No. 60/644,688; U.S. Ser. No. 60/644,636; U.S. Ser. No. 60/644,517; U.S. Ser. No. 60/644,609; U.S. Ser. No. 60/644,516; U.S. Ser. No. 60/644,546; U.S. Ser. No. 60/644,547; U.S. Ser. No. 60/644,638; U.S. Ser. No. 60/644,537; U.S. Ser. No. 60/644,637; U.S. Ser. No. 60/644,784; U.S. Ser. No. 60/644,687, each of which is herein incorporated by reference in its entirety.

INCORPORATION BY REFERENCE

The contents of the following U.S. Patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light, and with the capability to lower capital and/or operating costs. One primary example is illumination of a sports field.

B. Problems in the Art

Figure 1A:
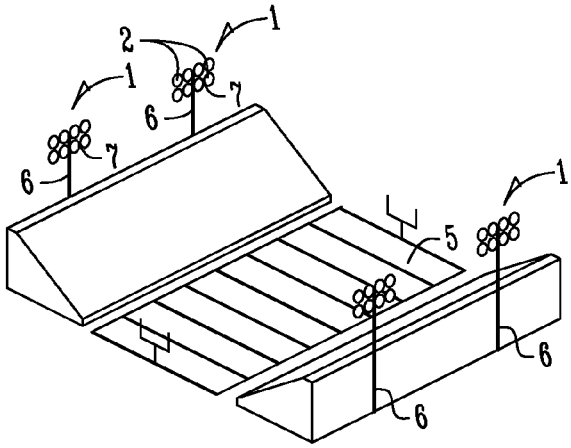

Illumination of sports fields is generally called sports lighting. FIGS. 1A-1G illustrate one such sports lighting configuration. Football field 5 of FIG. 1A is illuminated by a set of arrays 1 of light fixtures 2 elevated on poles 6 (see FIG. 1A). As is well known in the art, there are known methods to design the number, type, and position of poles 6 and fixtures 2 to provide a desired or required amount and uniformity of light for the field. There are usually pre-designed lighting quantity and uniformity specifications to follow.

Figure 1B:
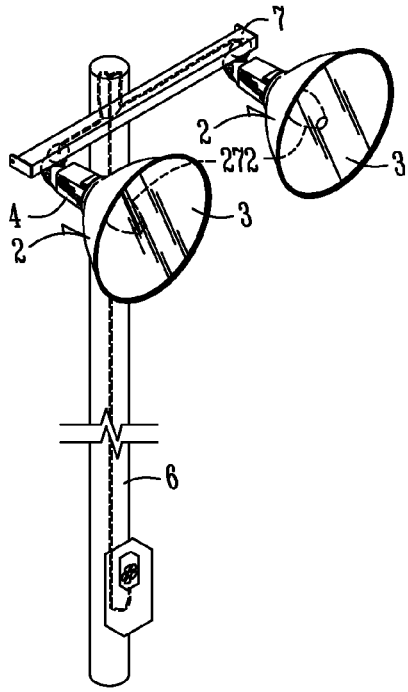

The most conventional form of sports lighting fixture 2 is a several inches (on the order of 24 inches) in diameter bowl-shaped aluminum reflector with a transparent glass lens 3 suspended from a cross arm 7 fixed to a pole 6 by an adjustable knuckle 4 (see FIG. 1B). Each light fixture 2 has some adjustability both around vertical and horizontal axes. Each fixture 2 can therefore be uniquely aimed relative to the target area or field 5 by adjustment of knuckle 4 relative to cross arm 7.

This general configuration of sports lighting fixtures 2 has remained relatively constant over many years because it is a relatively economical and durable design. It represents a reasonable compromise between the desire to economically control high intensity light to a distant target while at the same time minimizing wind load, which is a particularly significant issue when fixtures are elevated out-of-doors to sometimes well over 100 feet in the air. A much larger reflector could control light better. However, the wind load would be impractical. A significant amount of the cost of sports lighting systems involves how the lights are elevated. The more wind load, the more robust and thus more expensive, the poles must be. Also, conventional aluminum bowl-shaped reflectors are formed by a spinning process.

Therefore, competing interests and issues provide challenges to sports lighting designers. Some of the interests and issues can be at odds with one another. Designers have to balance a number of factors, for example, cost, durability, size, weight, wind load, longevity, and maintenance issues, to name a few. Attempts to advance the art have mainly focused on discrete aspects of sports lighting.

II. SUMMARY OF THE INVENTION

The present invention relates to a lighting fixture and structure to suspend it adjustably from a cross-arm. A relatively thin, single arm comprises the connection between cross-arm and mounting mogul or bulb cone, which in turn supports the remainder of the fixture. The single-arm provides several benefits for the fixture.

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) is robust and durable for most sports lighting or other typical applications for high intensity light fixtures of this type, whether outside or indoors;

b) can provide for decreased wind load or EPA for the fixture;

c) can provide for increased protection of wiring to the fixture;

d) can provide for decreased moment between the fixture and the mount.

These and other objects, features, advantages and aspects of the present invention will become more apparent with reference to the accompanying specification and claims.

III. BRIEF DESCRIPTION OF THE DRAWINGS

All references to Figures are to the drawings in attached Appendix A.

A. General Sports Lighting Systems

FIG. 1A and its sub-parts B-G illustrate generally a sports lighting system, and conventional components for a sports lighting system.

B. General Parts of Fixture 10

FIG. 2A is a diagrammatic, partial exploded view of a light fixture 10 according to an exemplary embodiment of the present invention and its sub-parts B-C illustrate fixture 10 assembled.

D. Lamp Cone 40

Figure 3A:
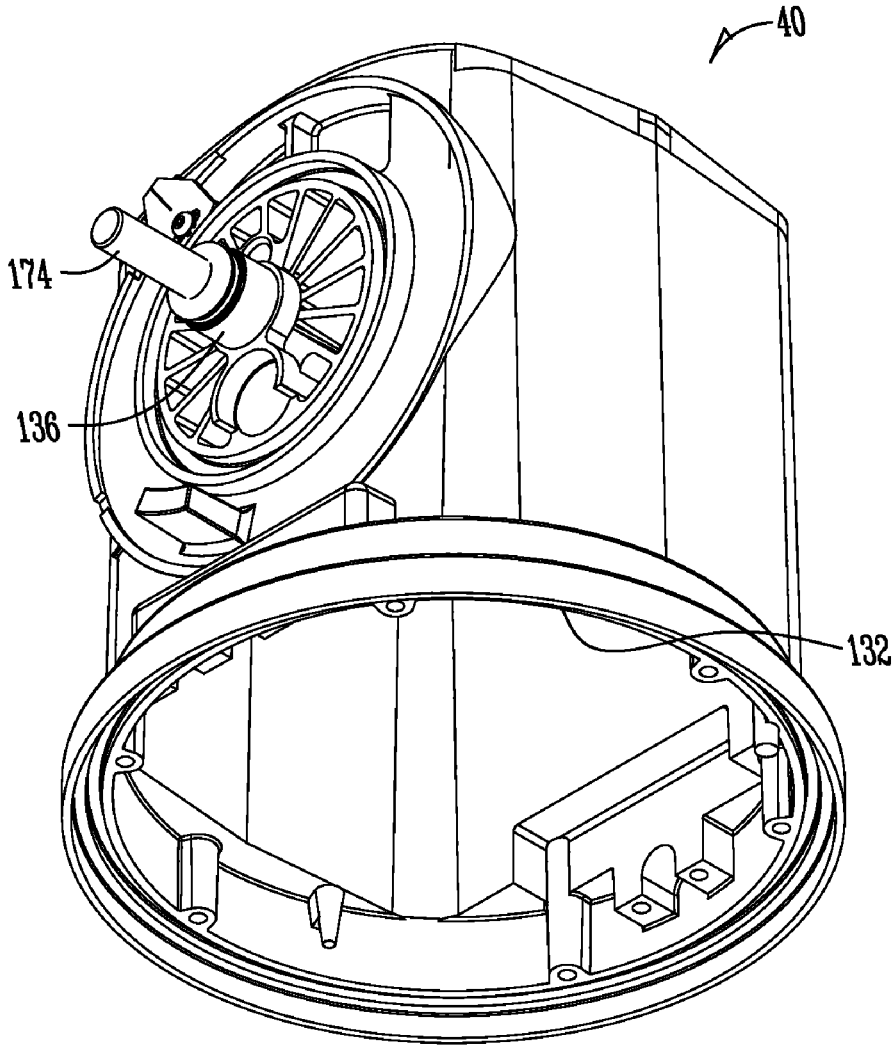
Figure 3B:
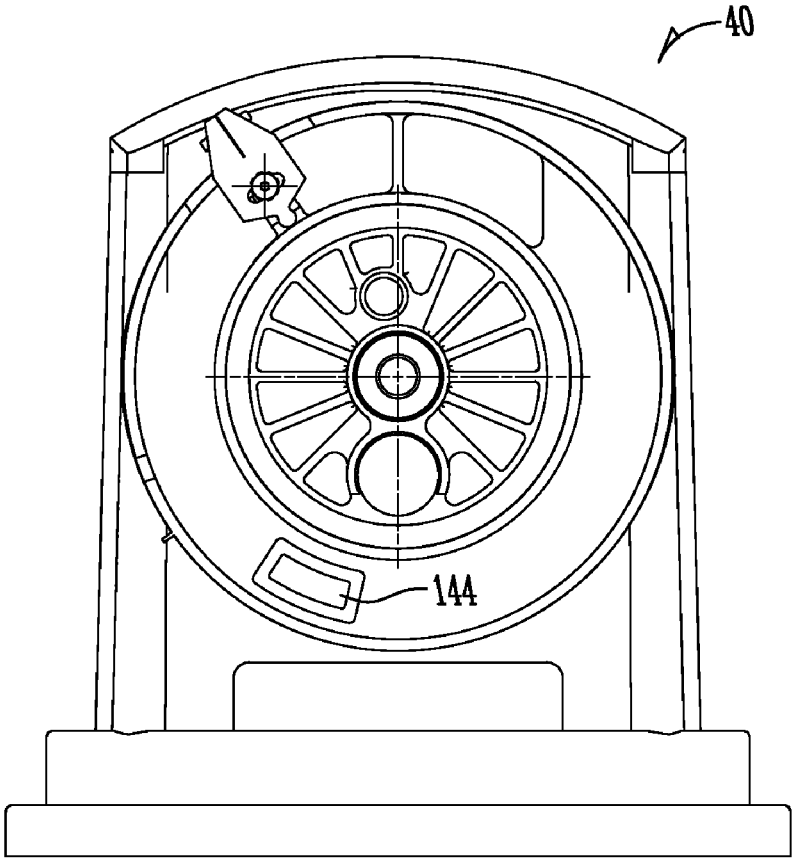
Figure 3C:
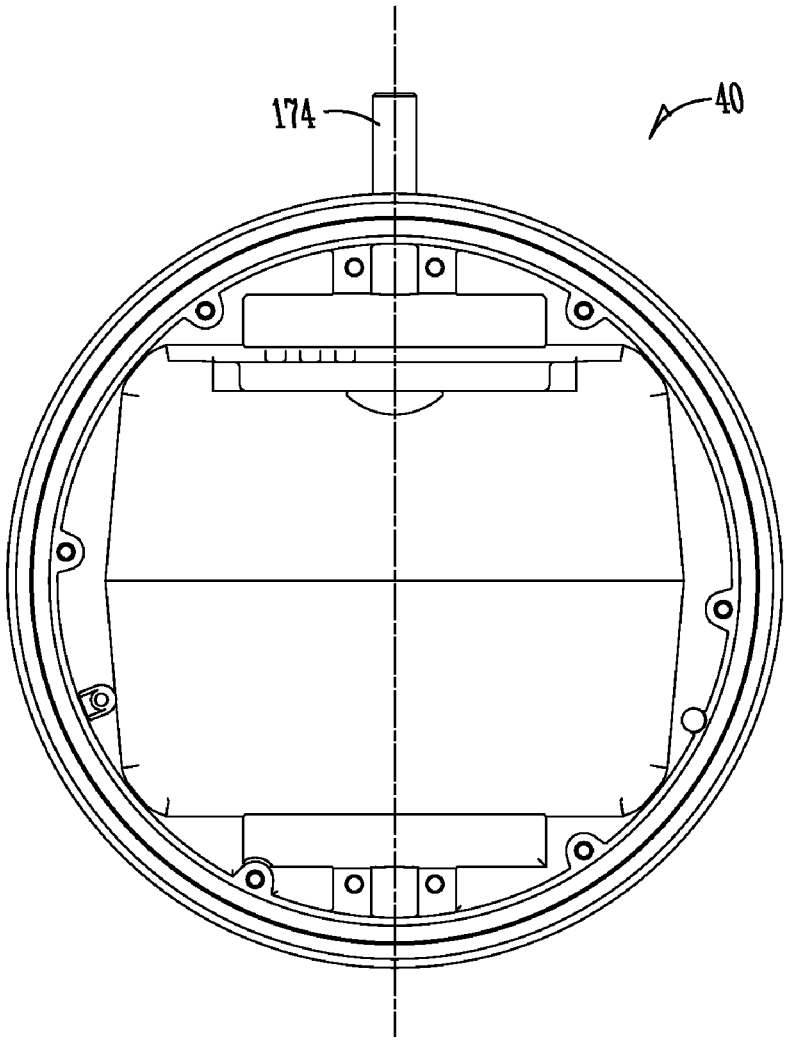
Figure 3D:
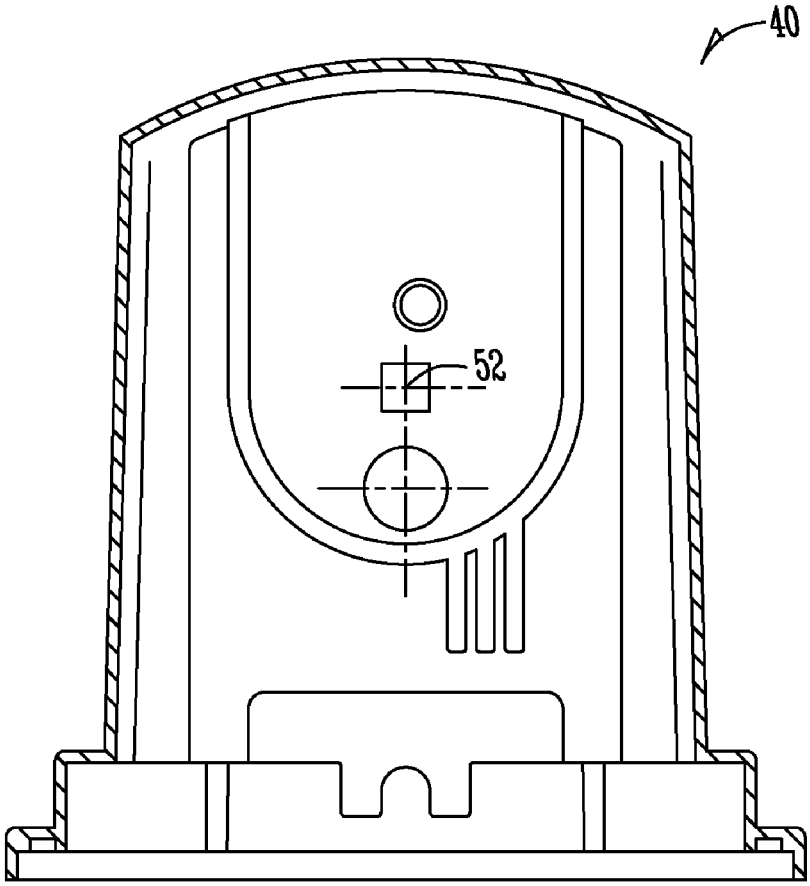
Figure 3E:
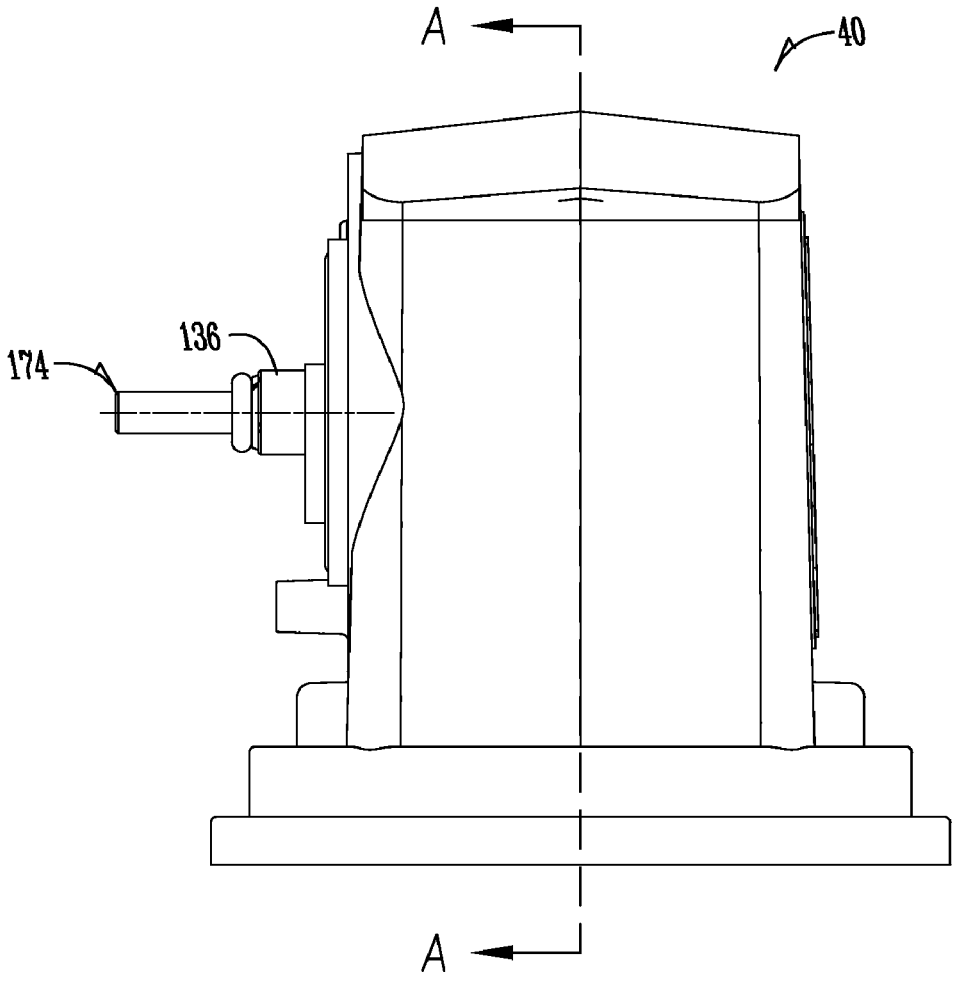

FIG. 3A and its sub-parts B-E are various plan, sectional, and isolated views of a lamp cone according to an aspect of the invention.

E. Lamp Cone 40 Affixed to Knuckle 50

Figure 4A:
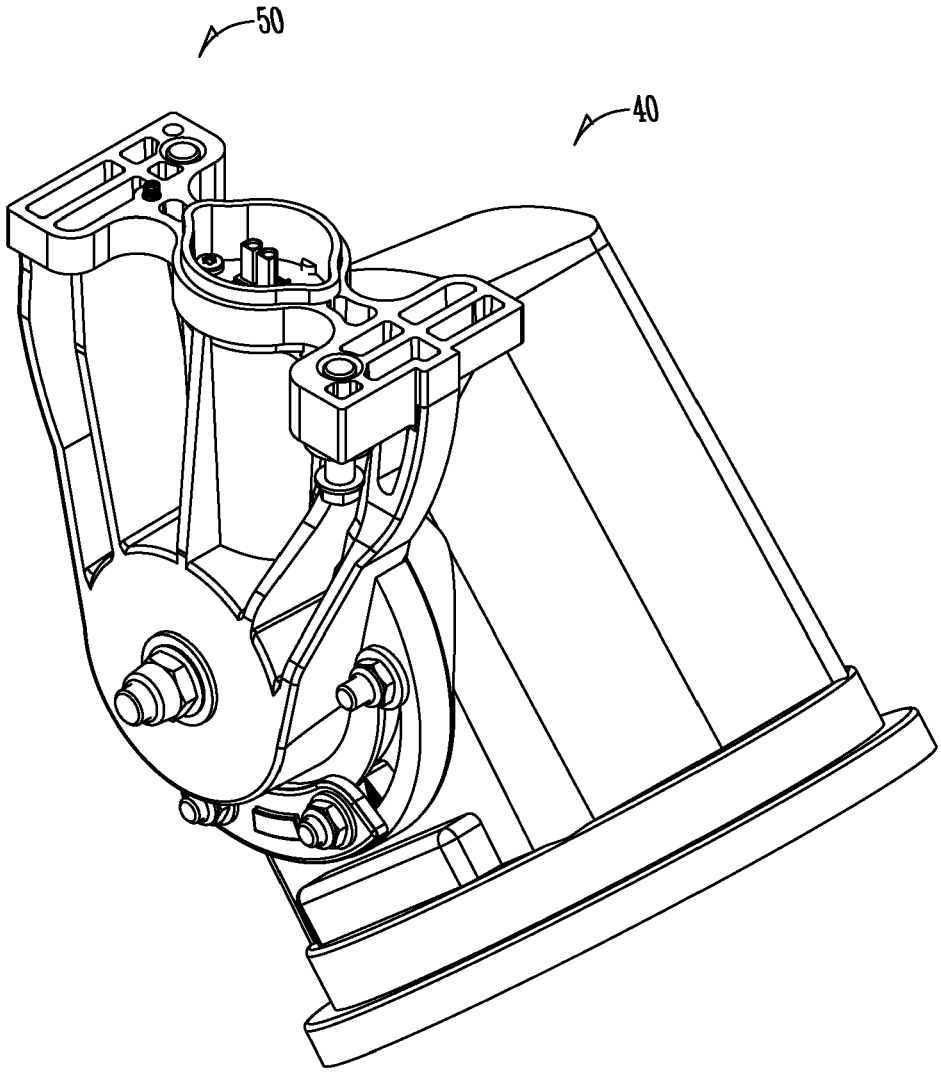
Figure 4B:
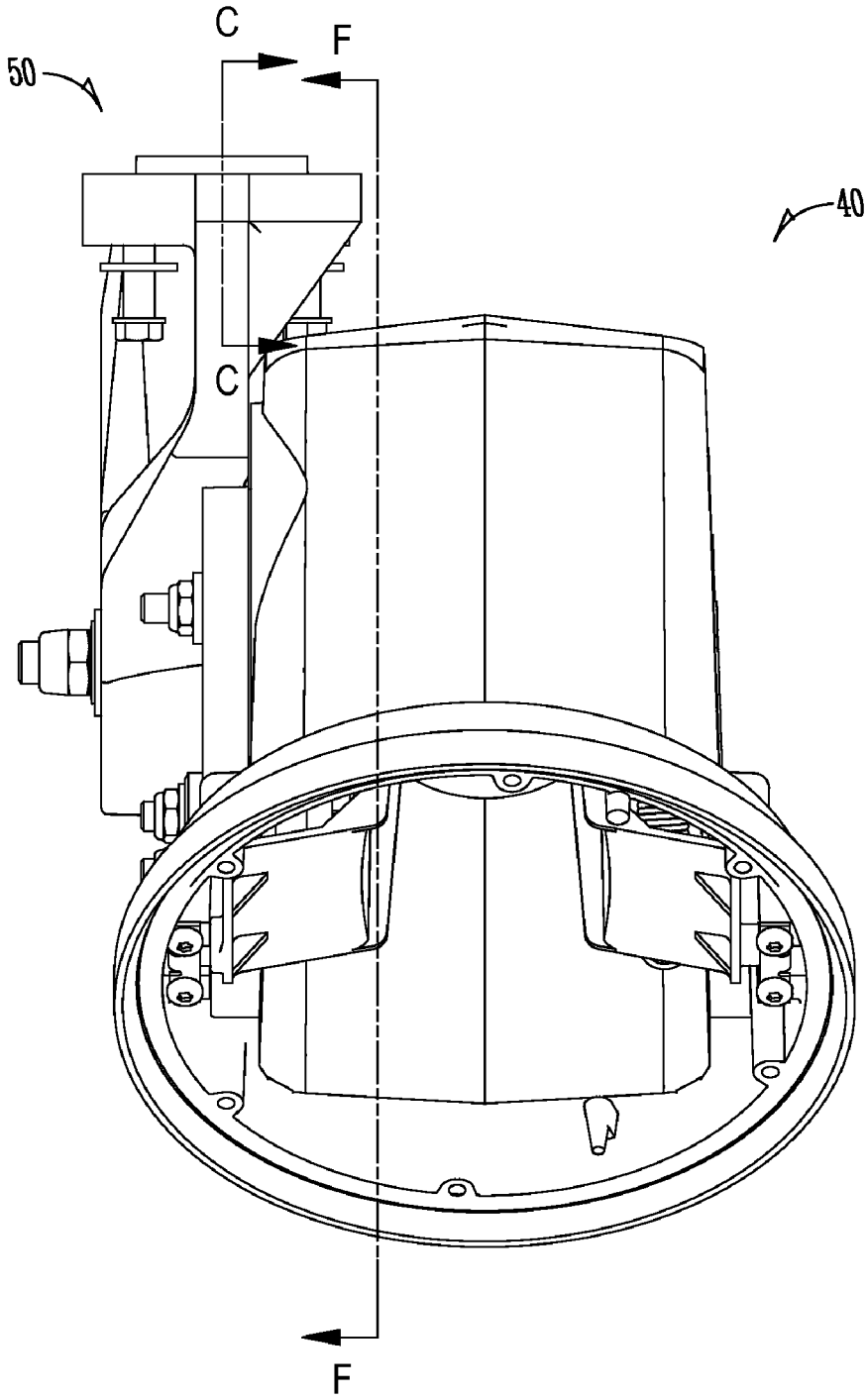
Figure 4C:
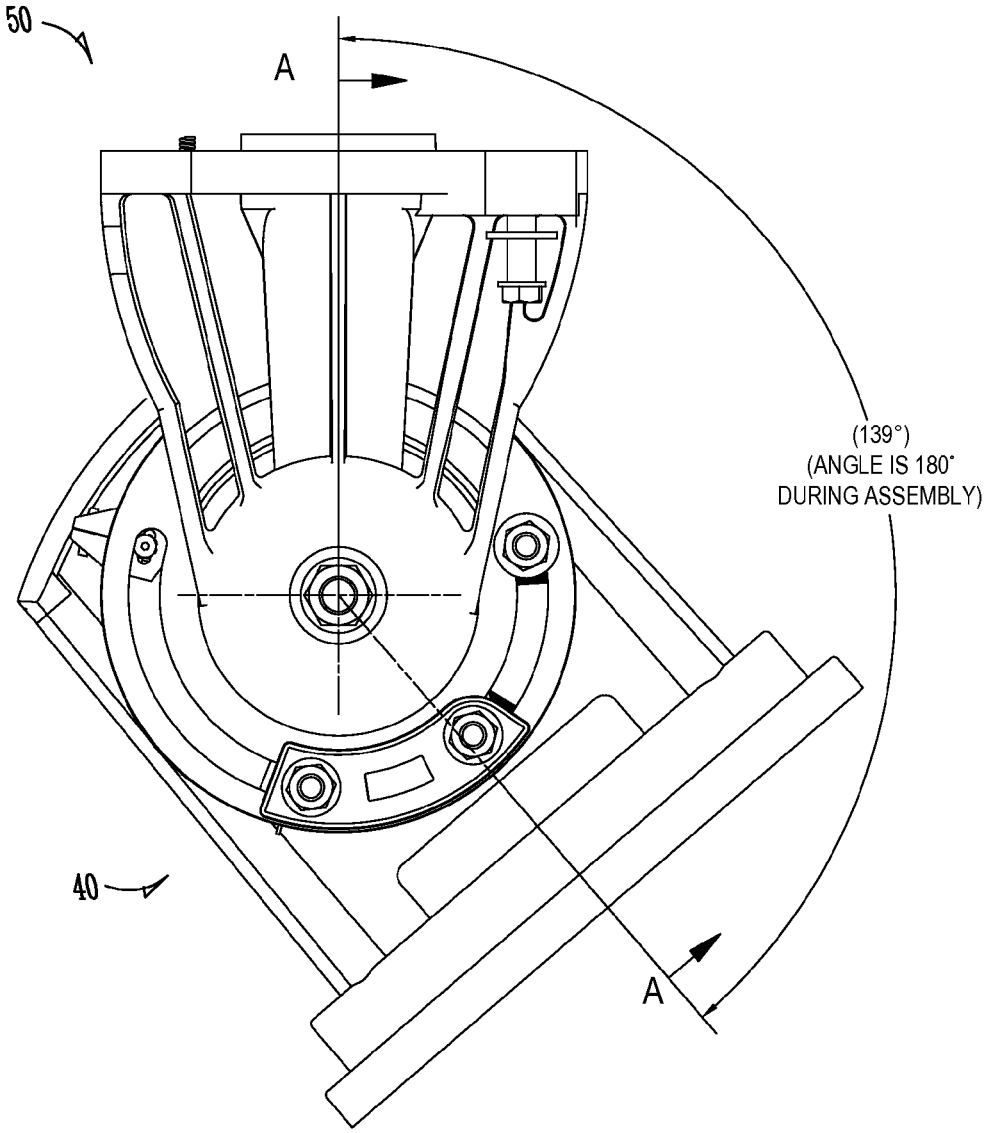
Figure 4D:
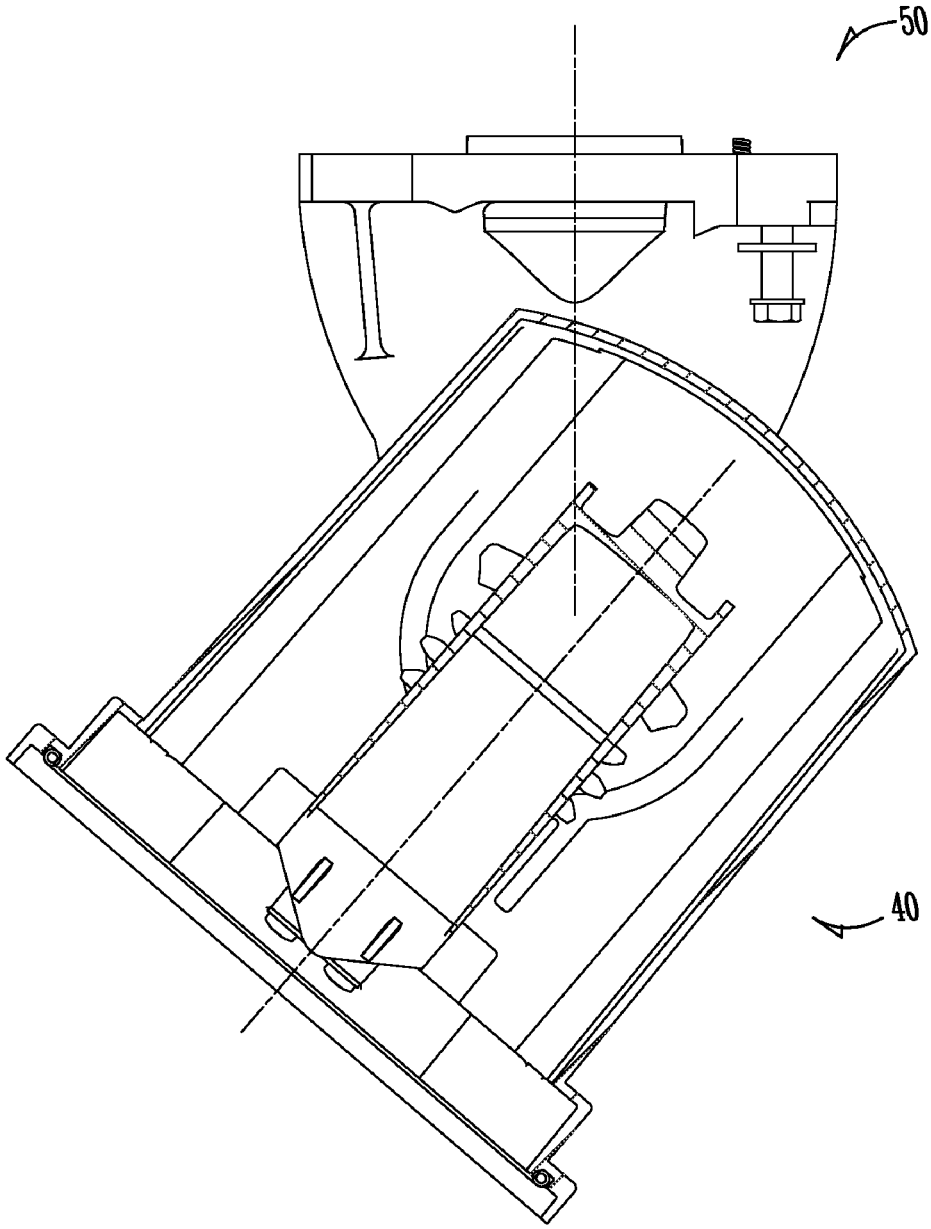
Figure 4E:
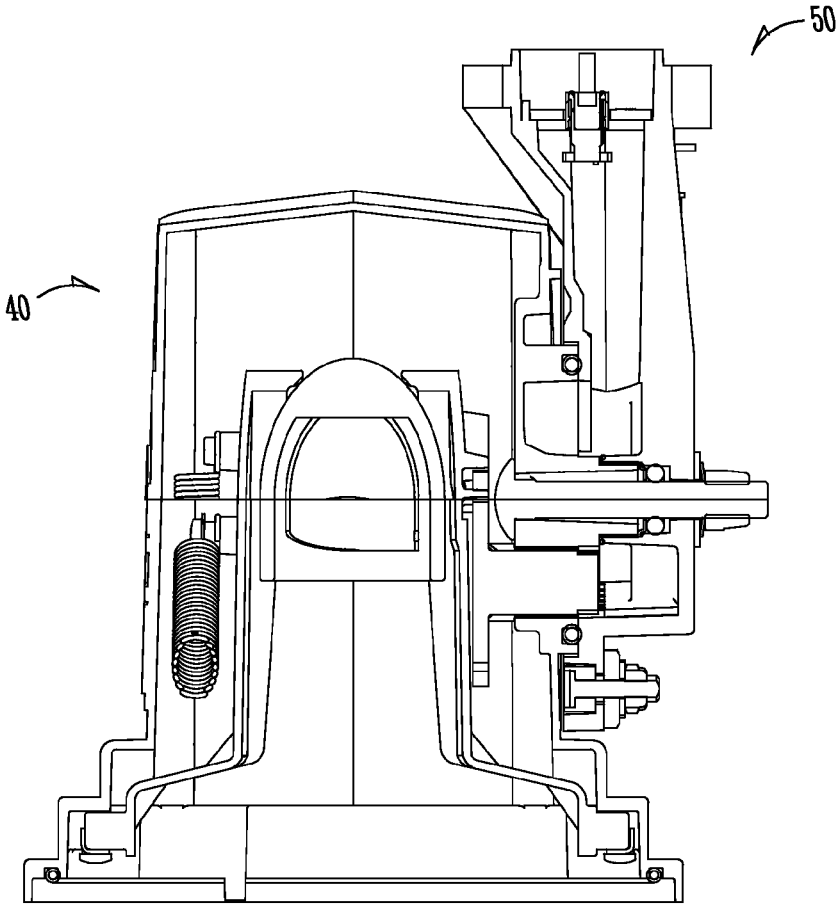
Figure 4F:
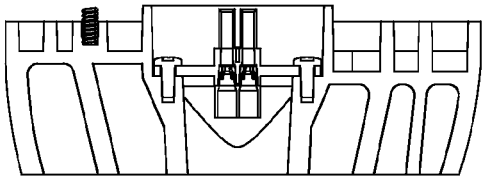

FIG. 4A and its sub-parts B-F are various perspective, plan, sectional, and isolated views of the lamp cone affixed to a knuckle according to an aspect of the invention.

F. Knuckle Plate 60

Figure 5A:
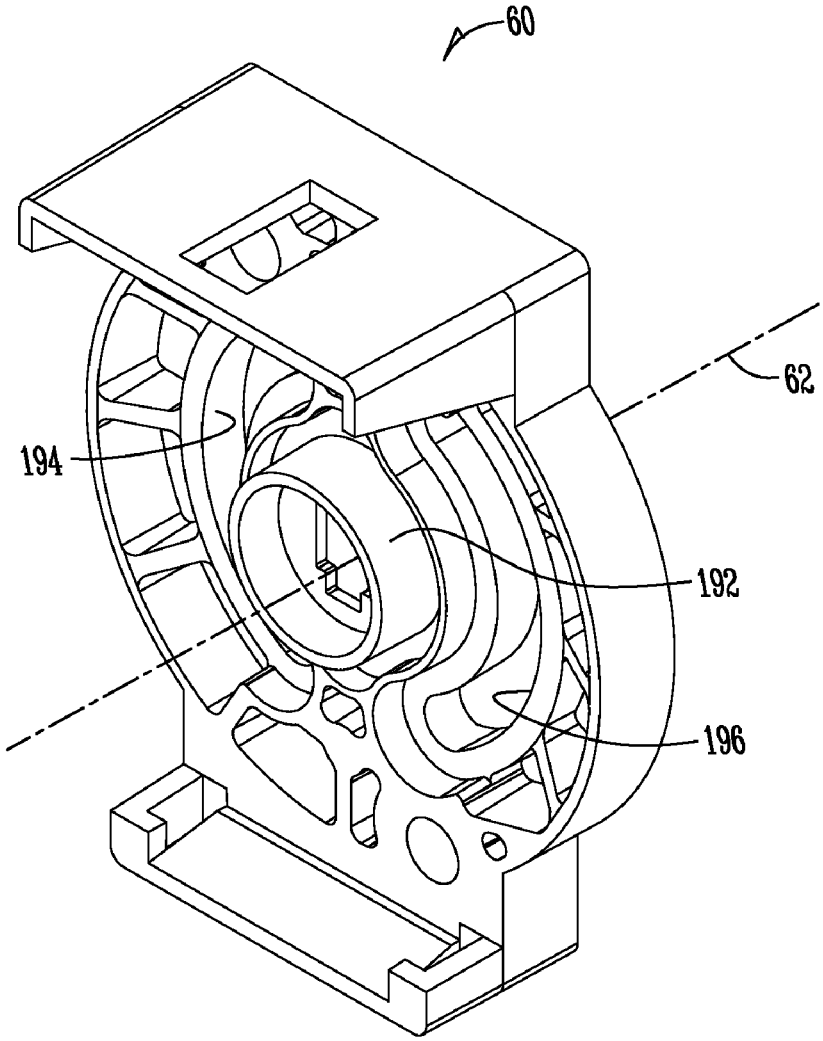
Figure 5B:
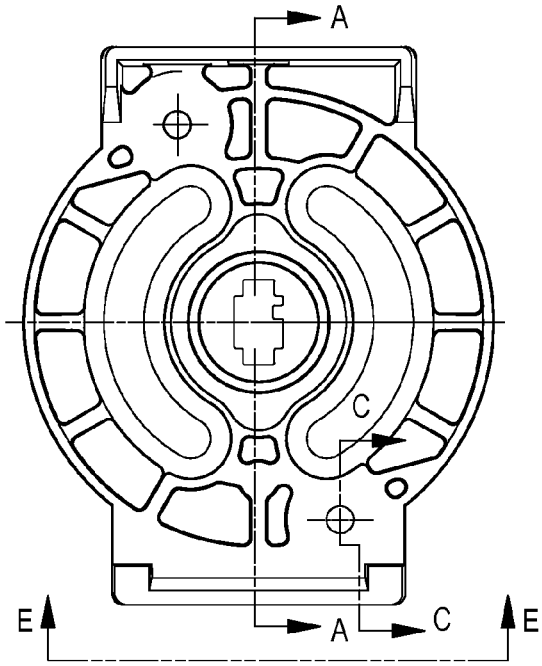
Figure 5C:
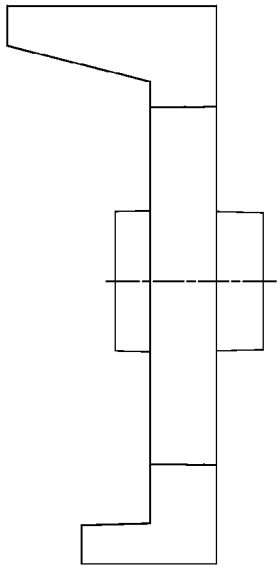
Figure 5D:
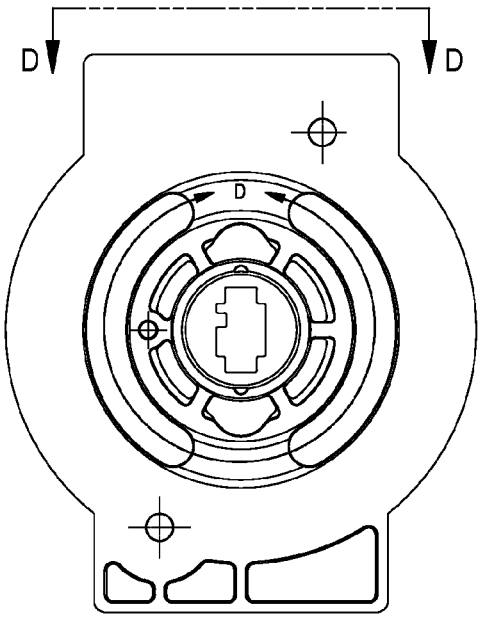
Figure 5G:
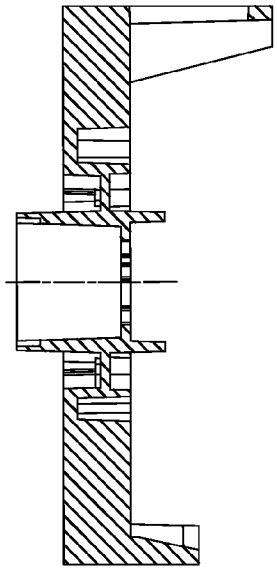
Figure 5E:
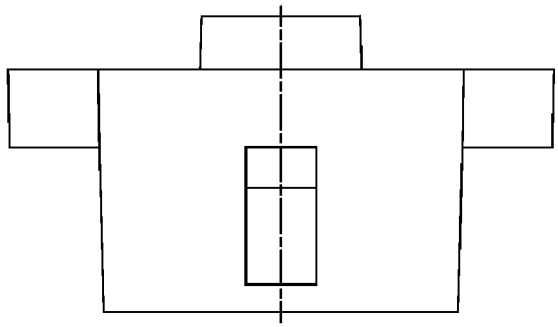
Figure 5F:
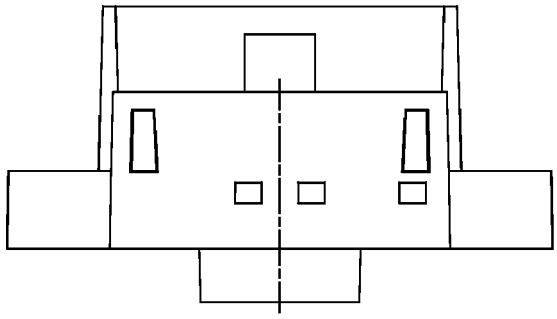
Figure 5H:
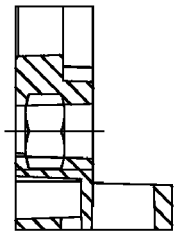

FIG. 5A and its sub-parts B-H are a perspective view, various plan views, sections, and isolated views of a knuckle plate according to an aspect of the invention.

Figure 6A:
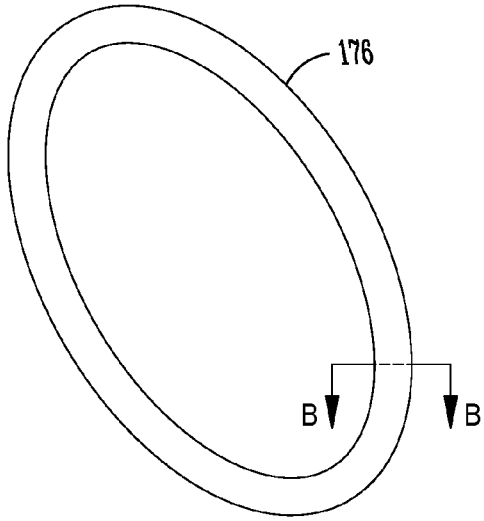
Figure 6D:
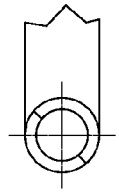
Figure 6B:
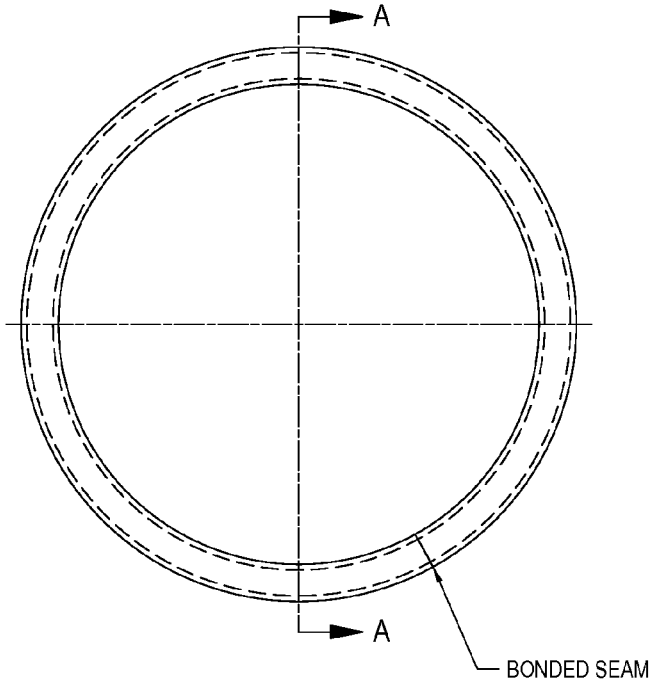
Figure 6C:
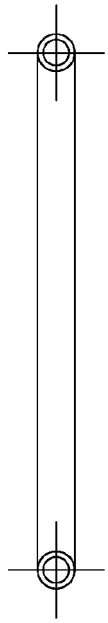

FIG. 6A and sub-parts B-D illustrate a gasket used with Fixture 10.

G. Knuckle 50

Figure 7A:
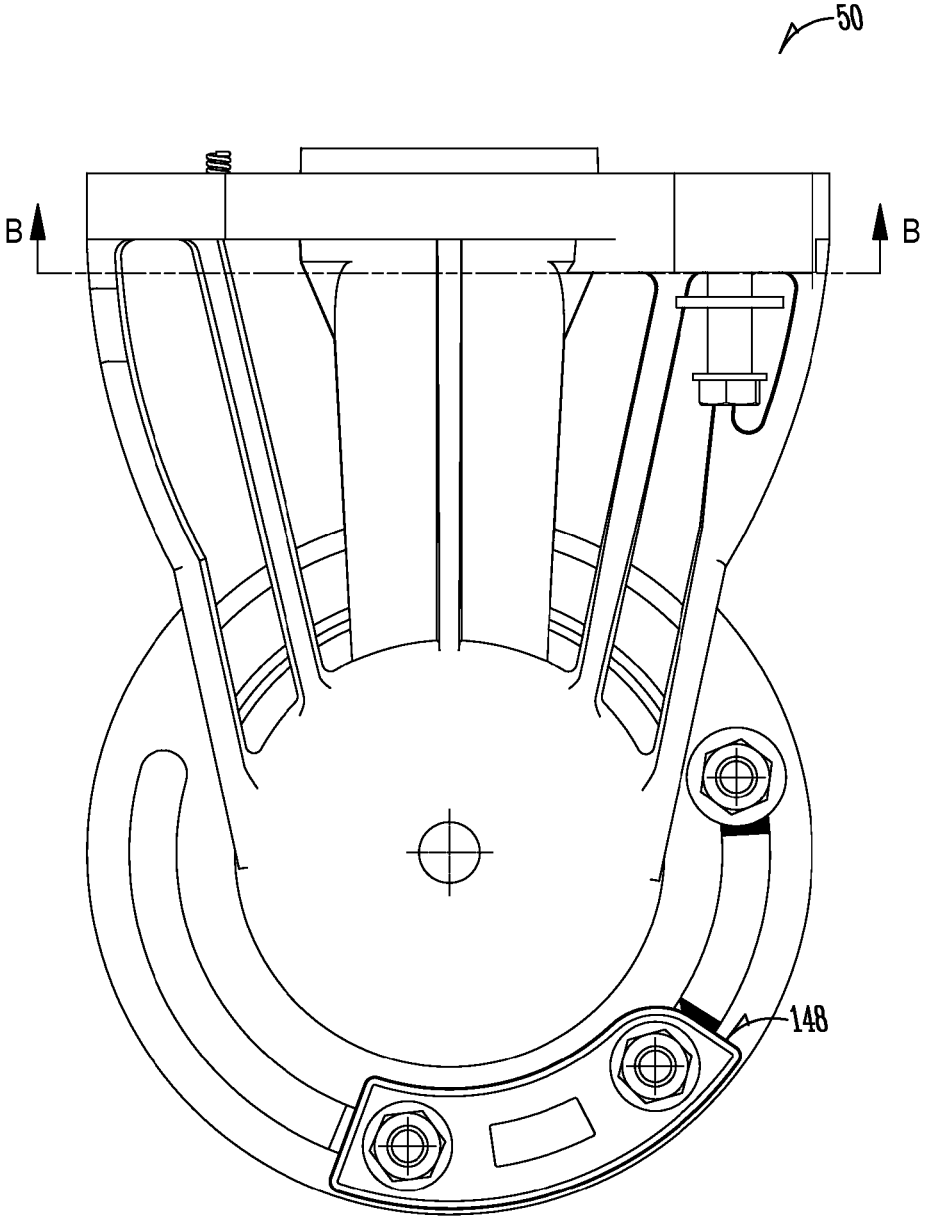
Figure 7B:
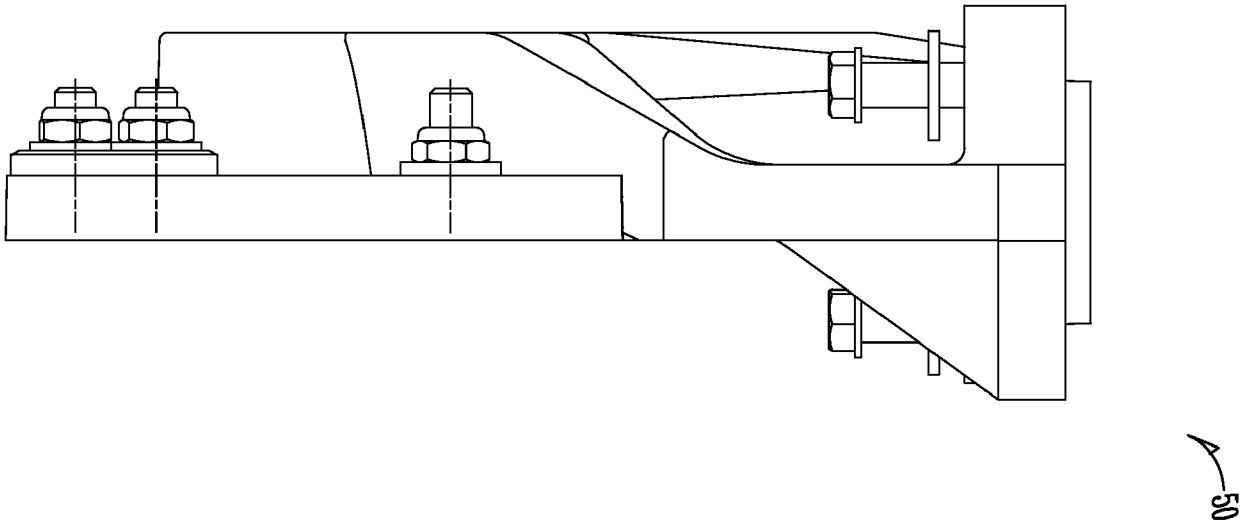

FIG. 7A and its sub-parts B-K are various views of a knuckle connectable between the knuckle plate of FIGS. 5A-H and the lamp cone of FIGS. 3A-E.

Figure 7C:
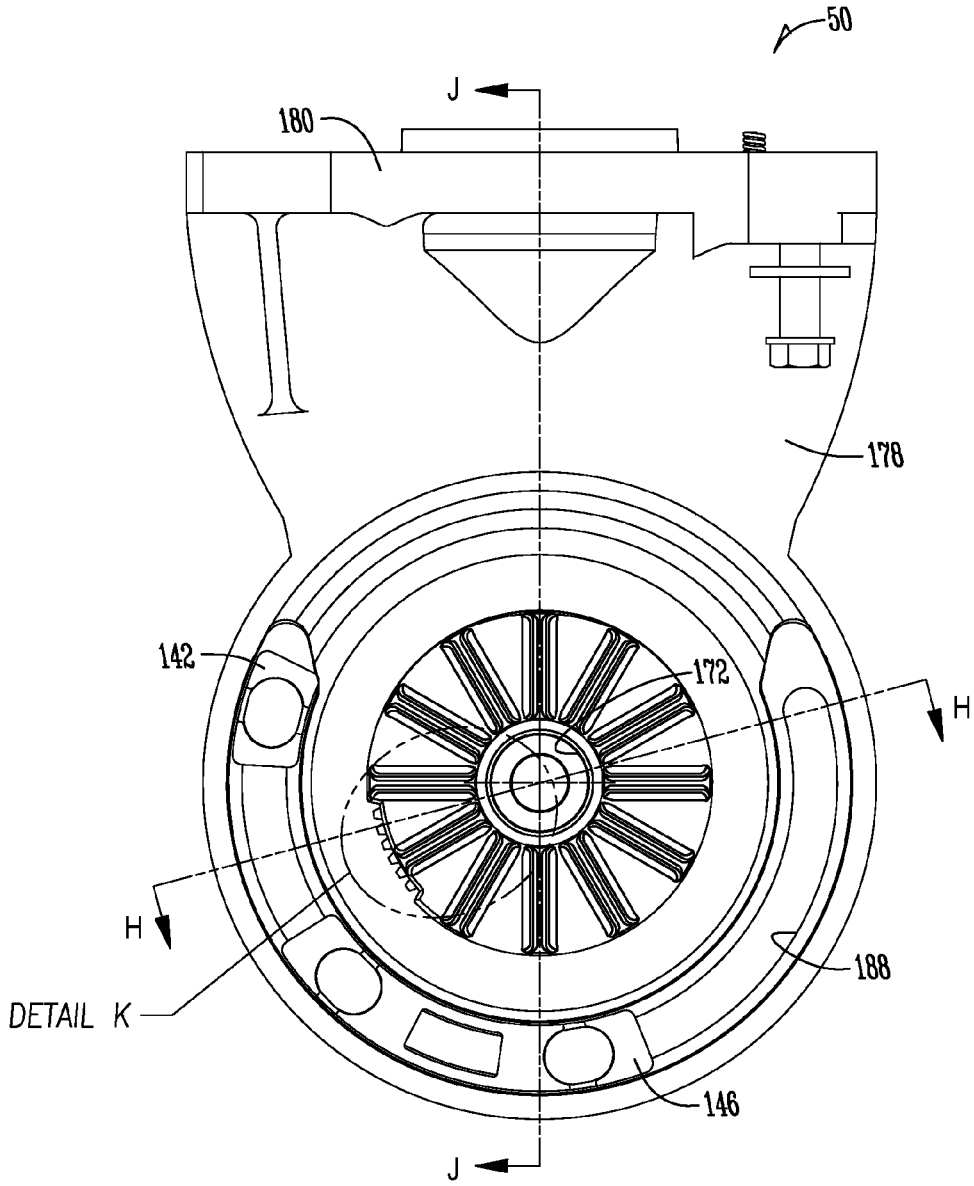
Figure 7E:
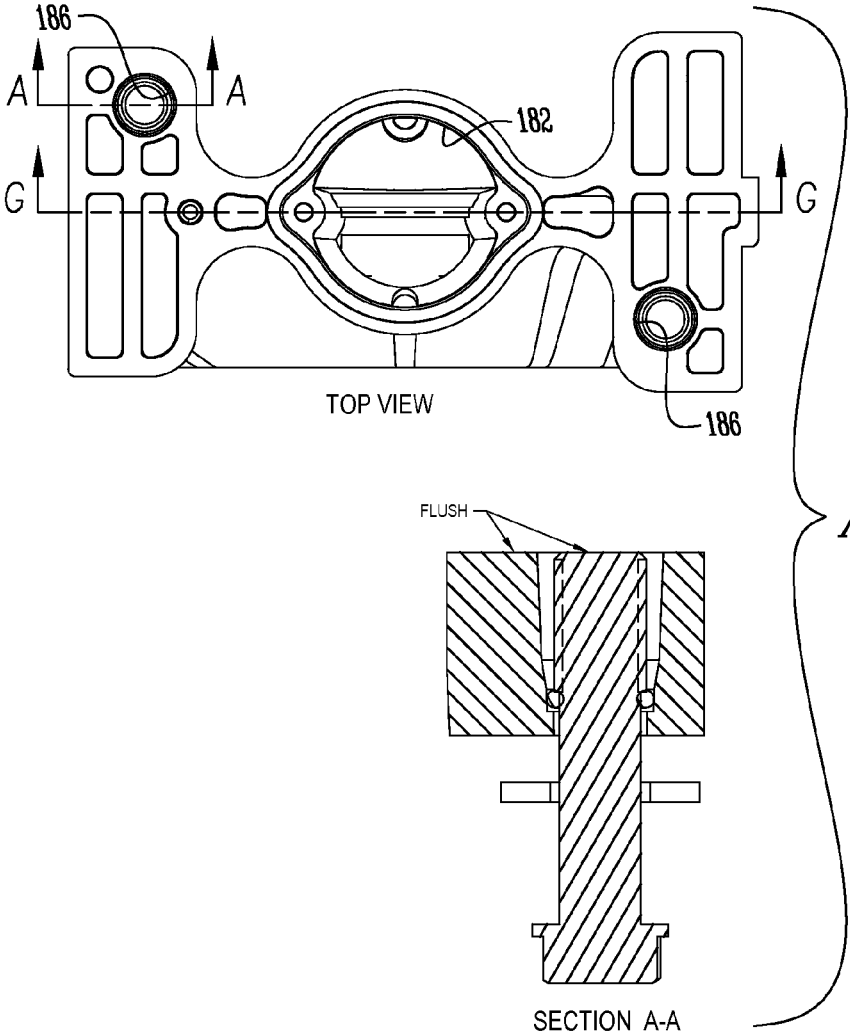
Figure 7F:
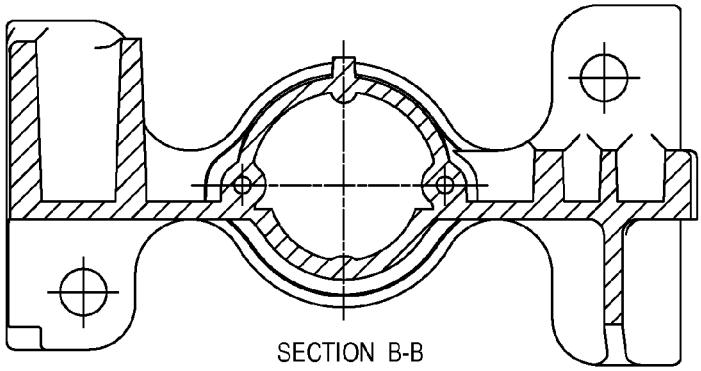
Figure 7G:
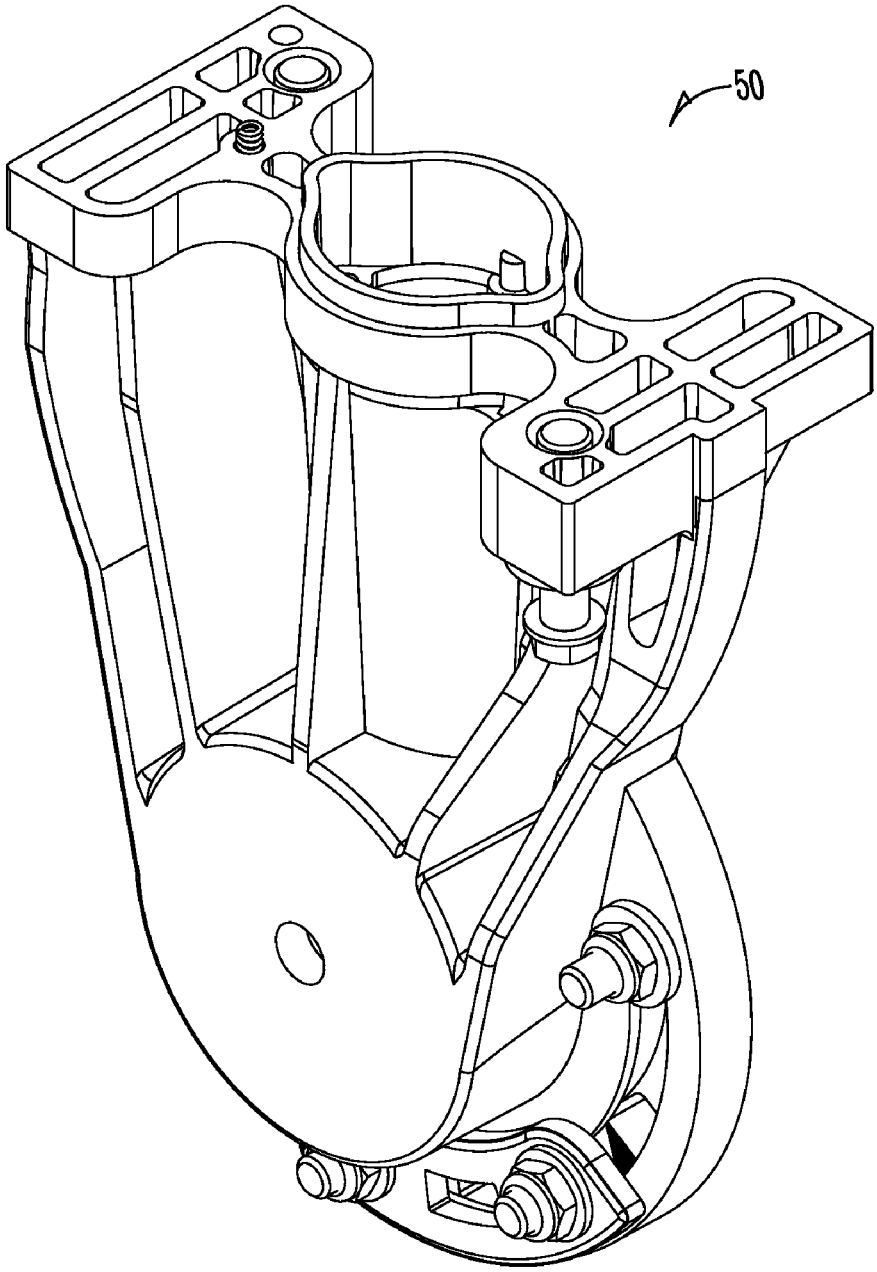
Figure 7H:
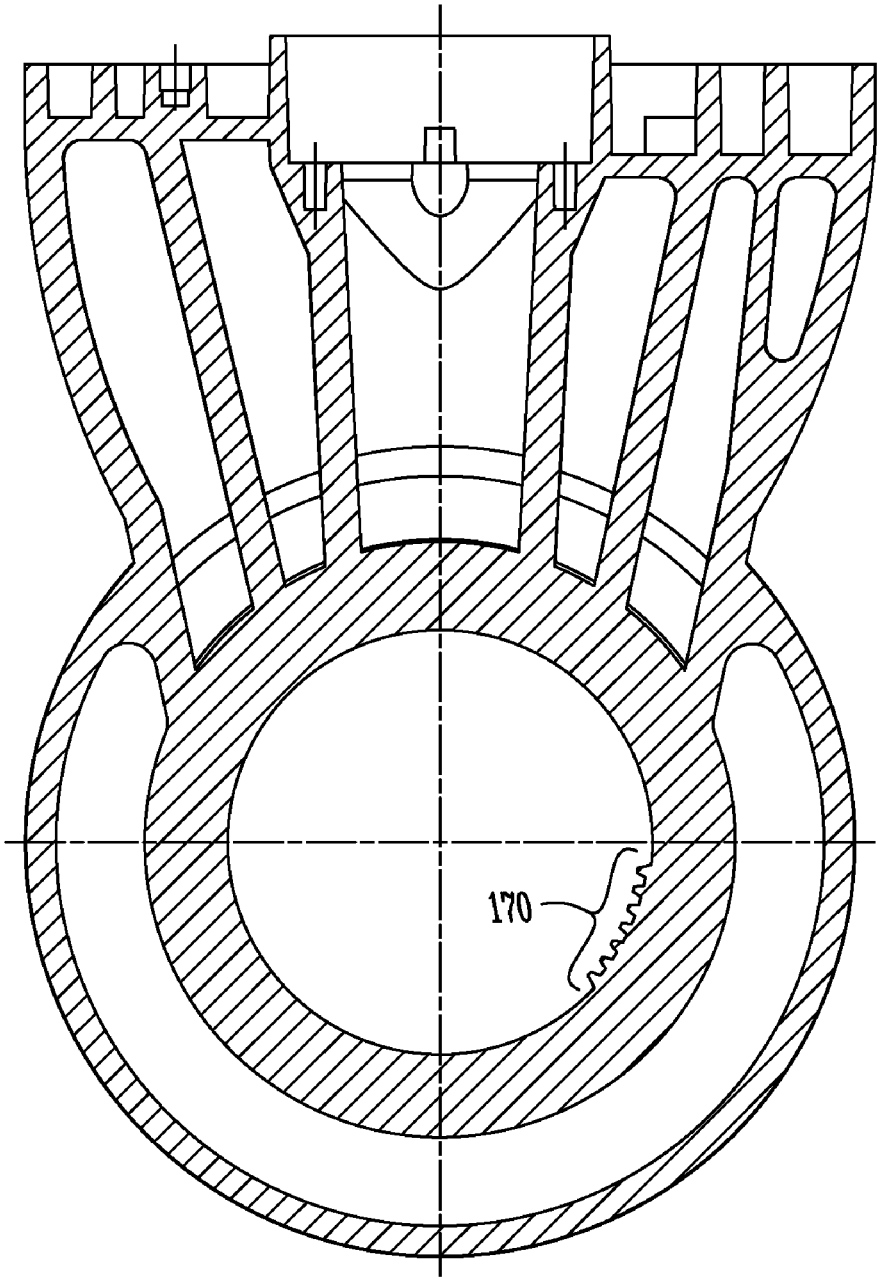
Figure 7I:
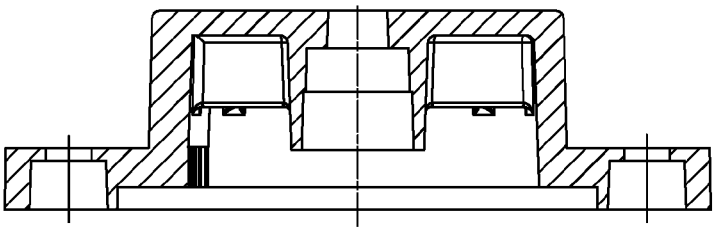
Figure 7J:
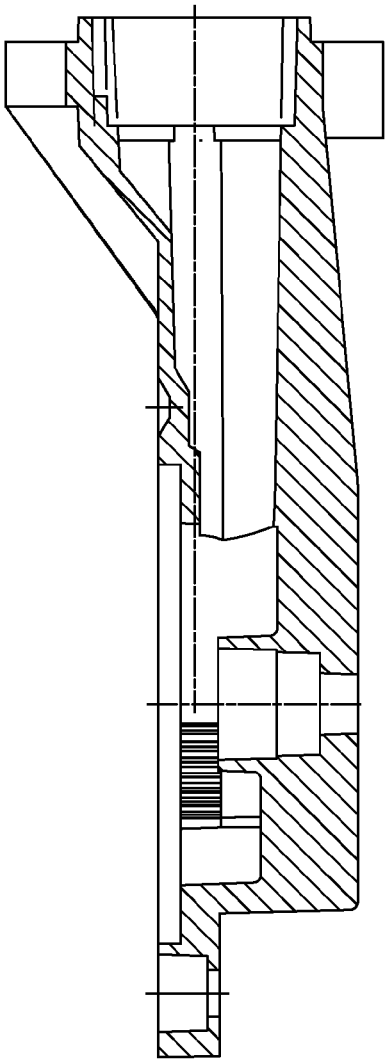
Figure 7K:
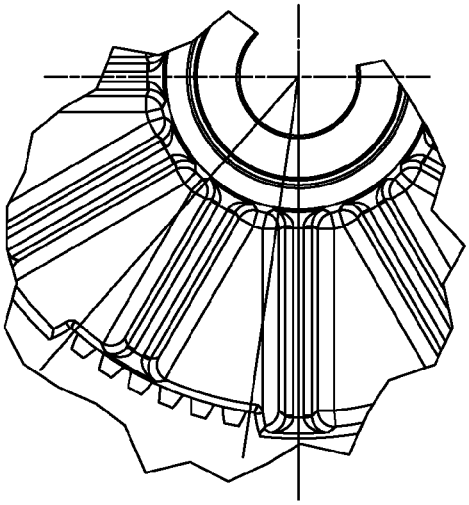
Figure 8A:
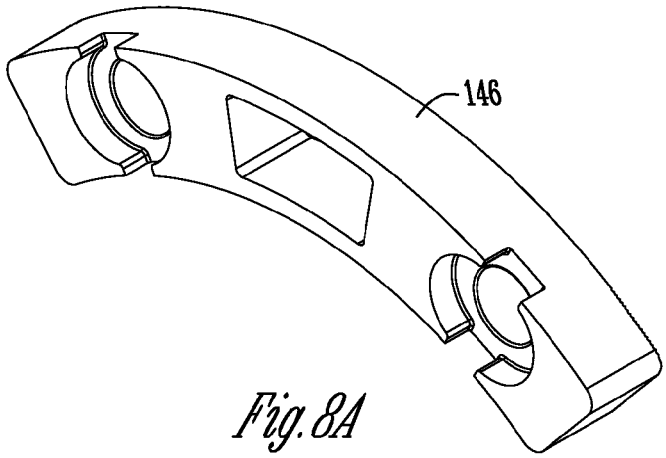
Figure 8B:
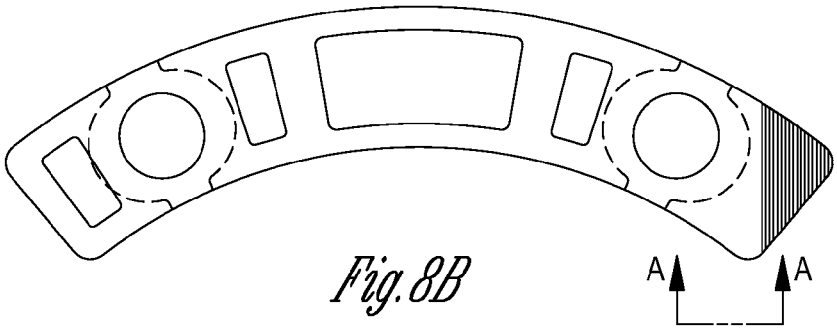
Figure 8C:
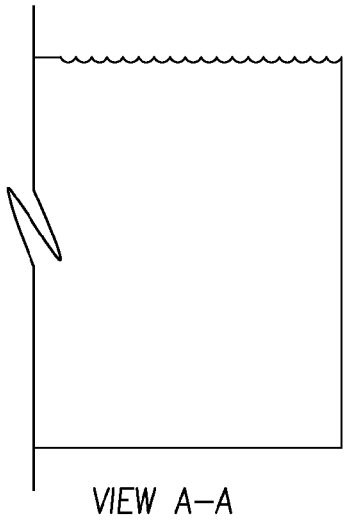
Figure 9A:
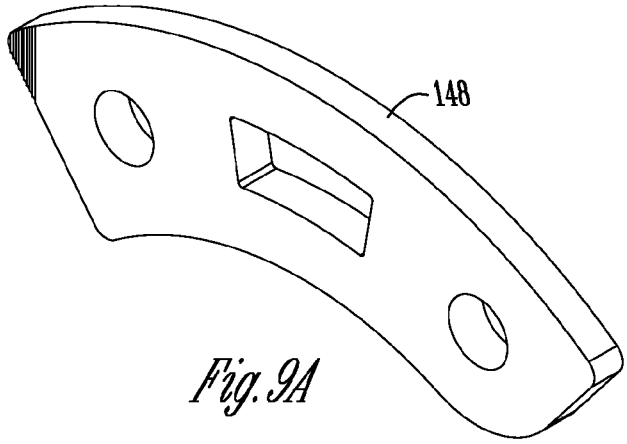
Figure 9B:
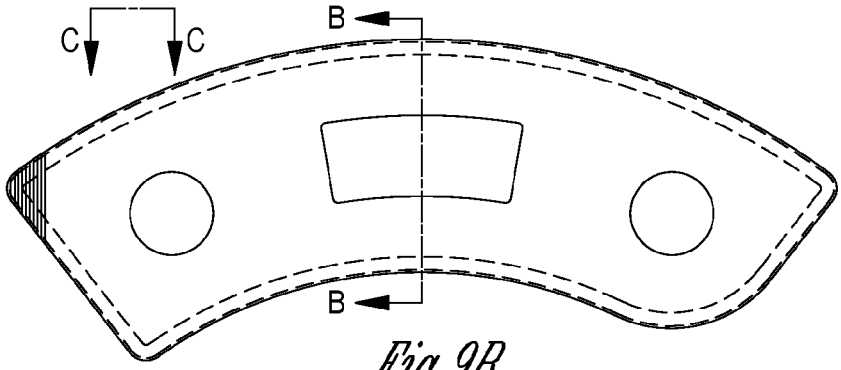
Figure 9C:
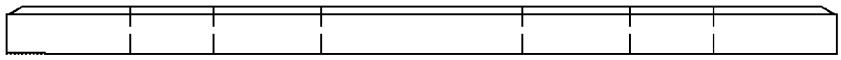
Figure 9D:
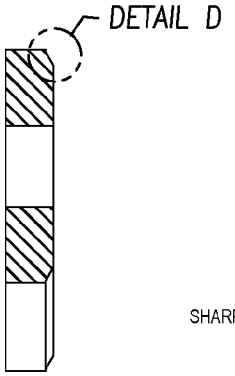
Figure 9E:
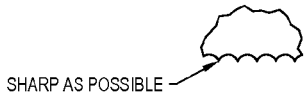
Figure 9F:
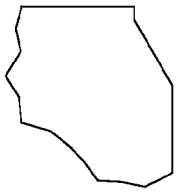
Figure 10A:
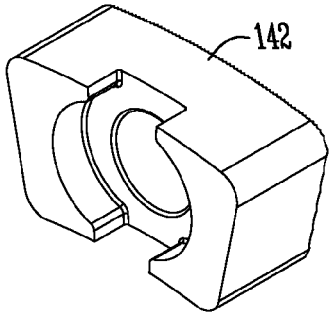
Figure 10B:
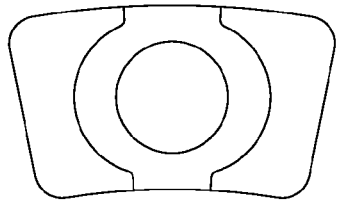
Figure 10C:
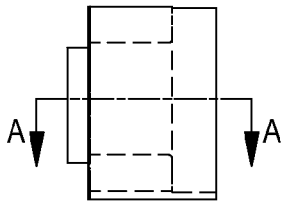
Figure 10D:
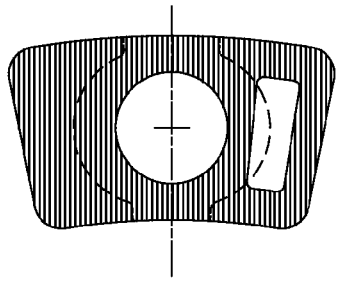
Figure 10E:
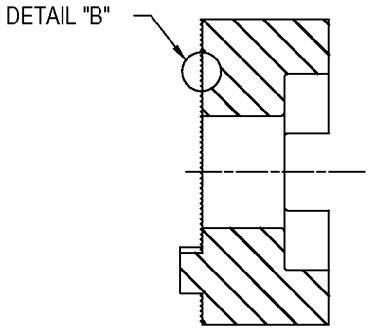
Figure 10F:
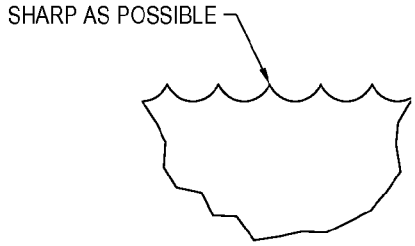

FIGS. 8A, 9A, and 10A, and their subparts 8B-C, 9B-F, and 10B-F are various views, respectively, of an inside strap, outside strap, and inside stop strap useable with the knuckle of FIGS. 7A-K and the lamp cone of FIGS. 3A-E to provide for accurate repositioning of the lamp cone if moved from factory alignment, for example, for maintenance purposes.

Figure 11:
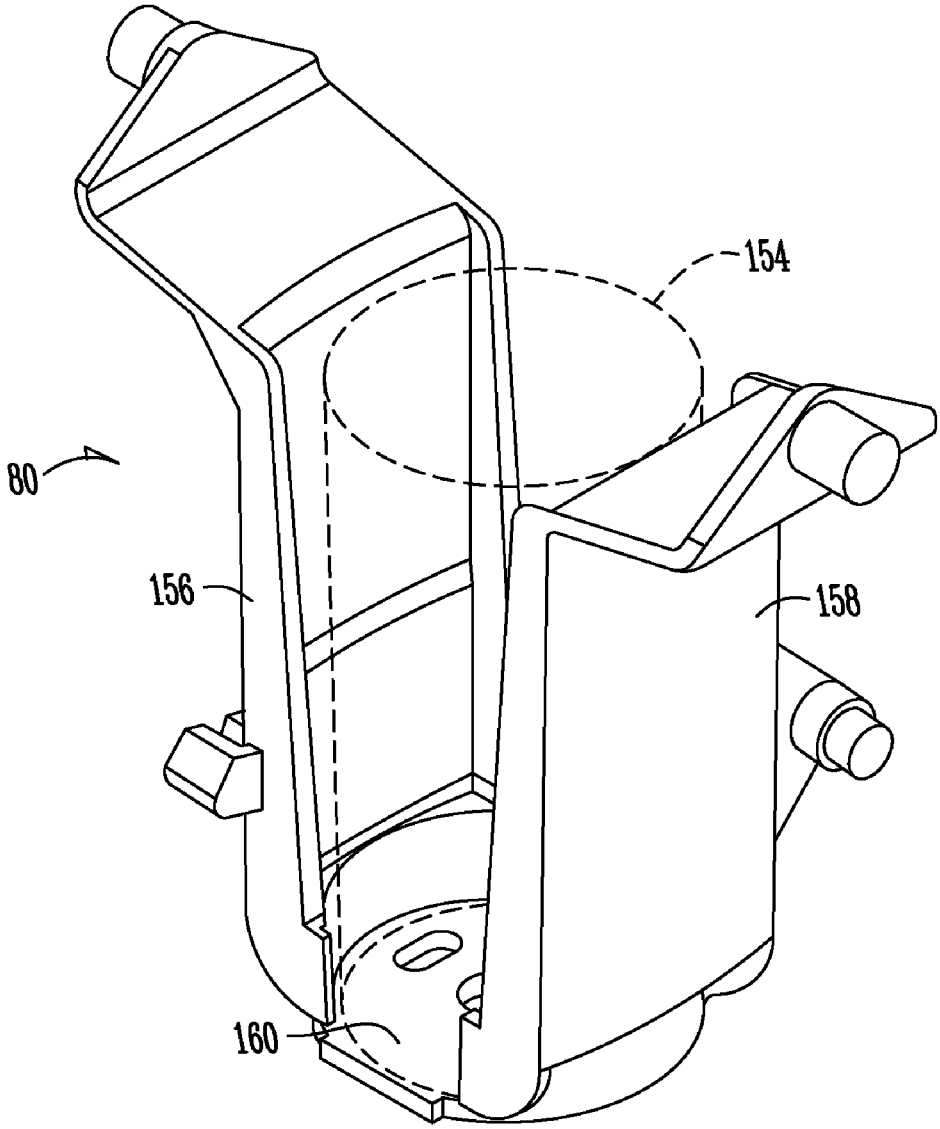

FIG. 11 illustrates a yoke useable with the lamp cone of FIGS. 3A-E to position a lamp in a socket.

IV. DETAILED DESCRIPTION OF EXEMPLARY EMBODIMENTS

A. Overview

Figure 1C:
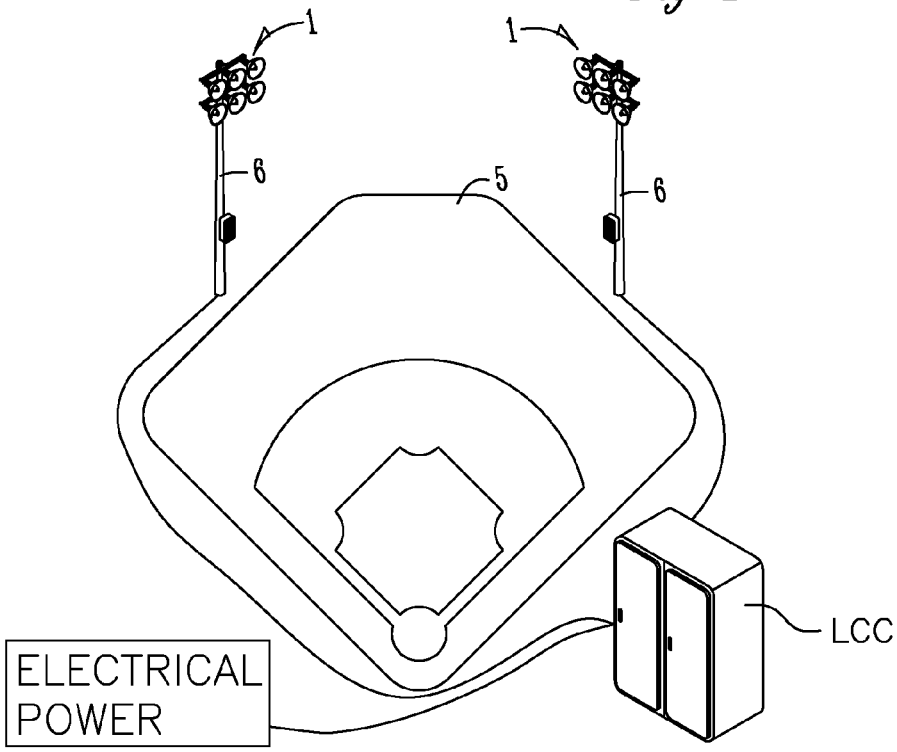
Figure 1D:
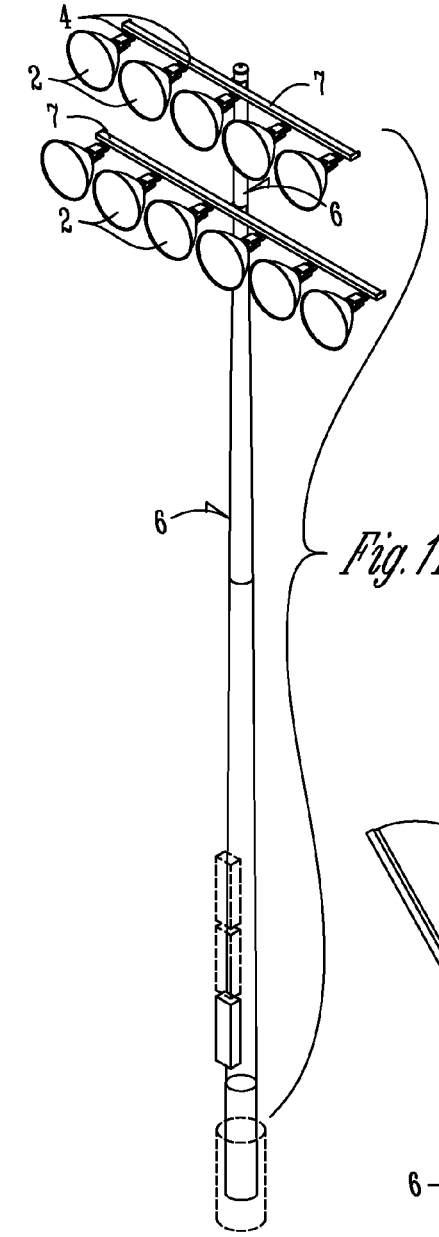
Figure 1G:
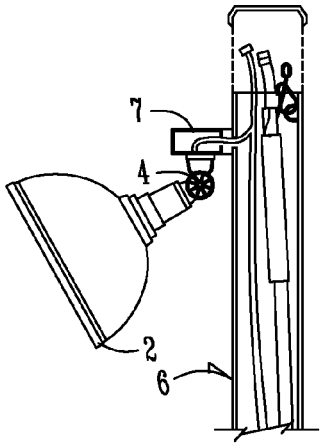
Figure 1E:
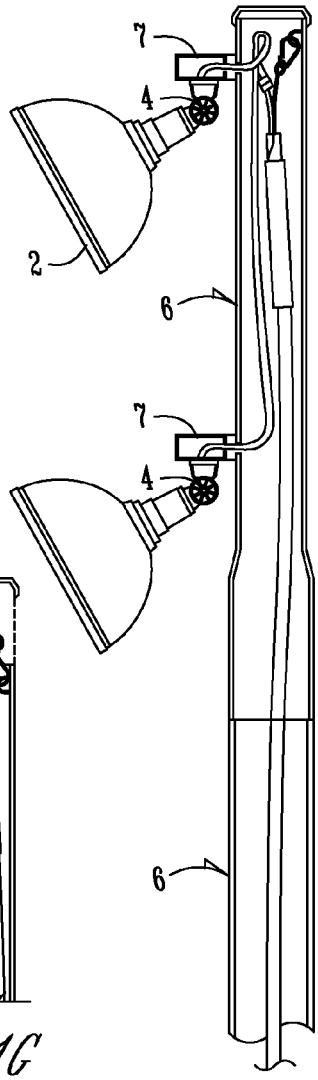
Figure 1F:
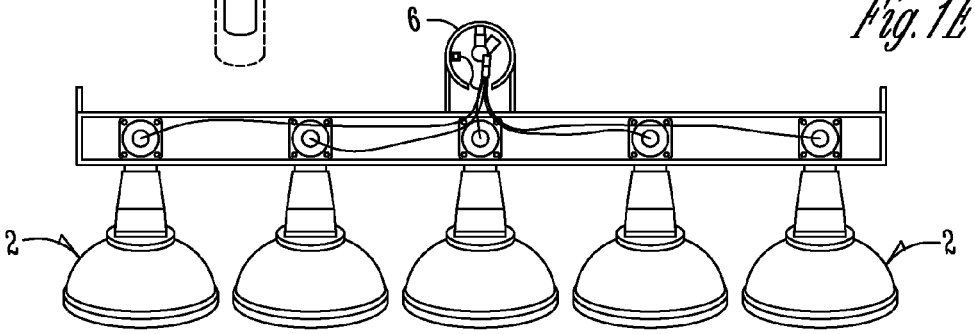

An embodiment of a light fixture will be described in the context of sports lighting, sports lighting fixtures, and sports lighting systems for the illumination of athletic fields such as shown in FIGS. 1A and 1C. The lighting must light the field and a volume of space above the field (collectively sometimes called the target area or target space), according to predetermined lighting level and uniformity specifications. The embodiment relates to fixtures that utilize high intensity discharge (HID) lamps, presently normally 1,000 watts or higher, of the metal halide type. Such installations generally have several arrays of fixtures usually elevated on two or more relatively tall poles (35 feet to 100 or more feet).

B. Exemplary Apparatus

1. Lighting Fixture 10 Generally

FIG. 2A shows the basic components of sports lighting fixture 10 in exploded form. FIGS. 2B and C show it in perspective form. Fixture 10 has some similar general components to state-of-the-art sports lighting fixtures, but introduces some different structural components and concepts. Mounting or knuckle plate 60 (360 Aluminum with polyester powder coat) bolts to the underside of a cross-arm 7. It has adjustability around vertical axis 62 (see FIGS. 2A and 5A). Knuckle 50 (360 Aluminum with polyester powder coat) bolts at one end to the bottom of knuckle plate 60 and extends to a pivot connection to lamp cone 40 along axis 52 at its other end (See FIGS. 2A and 3D). It should be appreciated that knuckle 50 essentially supports the remainder of fixture 10 and does so with essentially one arm extending from a cross-arm down to one side of lamp cone 40. Knuckle 50 is a relatively non-complex structure.

Lamp cone 40 (360 Aluminum with polyester powder coat) pivots around axis 52 relative to knuckle 50. It contains a socket 154 (see FIG. 11, commercially available) which is bolted to the flat web 160 between the arms 156 and 158 of yoke 80. Lamp 20 (Musco Corporation Z-LAMP™ brand lamp) has a threaded base that can be screwed in and out of socket 154 (shown screwed into operating position in FIG. 2A) to install or remove lamp 20.

2. Lamp Cone 40, Knuckle 50, and Knuckle Plate 60

Lamp cone 40, knuckle 50, and knuckle plate 60 form the adjustable joint between cross arm 7 and reflector frame 30. Lamp cone 40 also supports lamp 20. FIG. 3A and subparts illustrate details about lamp cone 40. Lamp cone 40 is basically enclosed except for front opening 132 to which reflector frame 30 is bolted and sealed with a gasket, and several openings in the side (e.g., for the knuckle bolt and a pinion gear).

Lamp cone 40 pivotally attaches to knuckle 50 by inserting laterally projecting boss or pivot 136 on the side of lamp cone 40 into a complimentary circular cut-out or receiver 172 in one lateral side of knuckle 50 (see FIG. 7C). Knuckle bolt 174 (see FIGS. 3A and 4A-C), with appropriate nut and washers, holds lamp cone 40 from separation from knuckle 50 when assembled together. Gasket 176 (FIGS. 6A-D) fits between lamp cone 40 and knuckle 50 concentrically about pivot receiver 172 and bolt 174 to deter water, insects, or dirt from entering into knuckle 50. As can be seen in FIGS. 4A-F and 7D1-7D4, when these parts are assembled, complimentary structure on the interfaces of lamp cone 40 and knuckle 50 act as bearing surfaces and retaining structure to provide for smooth, accurate rotation of lamp cone 40 relative to knuckle 50.

As shown in the drawings, knuckle 50 connects to knuckle plate 60 (see FIGS. 5A-H) which in turn is fixedly mounted to cross arm 7 (see FIGS. 7D1-7D4). Arm portion 178 of knuckle 50 extends to a mounting end 180. Knuckle plate 60 bolts to the bottom of cross arm 7 by one bolt into each curved slot 194 and 196. This allows rotational adjustment of knuckle plate 60 relative to cross arm 7 over the range of curved slots 194 and 196.

It should be noted that knuckle 50 is essentially a single arm suspending most of fixture 10 by its pivotal connection along the side of lamp cone 40. Unlike some existing fixtures which have the knuckle extend directly into the back of the lamp cone, and a pivot joint between the cross arm and the lamp cone, knuckle 50 provides certain functional advantages. First, although fixture 10 might be somewhat heavier than a spun aluminum reflector fixture, by placing the pivot point along the side of lamp cone 40, there is less moment caused by lamp cone 40, reflector frame 30, lamp 20, visor 70 and the other components on the distal side of that connection point. It is believed the moment is cut approximately in half. This is beneficial for long-term durability, especially for fixtures experiencing a variety of outdoors forces and conditions, including high winds. Less moment for the connection also deters slippage or change in relationship between the lamp cone and cross arm, which could affect aiming. Secondly, it allows for a shorter fixture, in the sense the fixture is pulled closer to the vertical plane of the cross arm. This helps present a lower EPA. Third, knuckle 50 provides for minimum exposure of power wires to the environment. The wires pass through knuckle plate 60 (from the interior of cross arm 7), through the interior of knuckle 50, and into the interior of lamp cone 40, completely enclosed by structure. Fourth, it is part of a relatively non-complex structure for the support and aiming of the fixture.

Round opening 182 at the mounting end of 180 of knuckle 50 fits around downwardly extending tube 192 on the bottom of knuckle plate 60. Bolts through bolt holes 186 of mounting end 180 of knuckle 50 extend into curved slots 194 and 196 in knuckle plate 60. This combination allows a range of rotational adjustment of knuckle 50 relative to knuckle plate 60 (over the range defined by curved slots 194 and 196 of knuckle plate 60). In this manner, there is some adjustability of knuckle 50 around a vertical axis, once knuckle plate 60 is mounted to the underside of cross arm 7.

Curved slot 188 in knuckle 50 provides a limit for pivoting of lamp cone 40 about knuckle 50. Knuckle 50 can therefore be used for aiming fixtures 10 to either side of cross arm 7. Additionally, lamp cone 40 can be set to a given aiming angle relative to knuckle 50 as follows. An inside stop strap 142 can be fixed to boss 144 in the face of lamp cone 40. Inner and outer stop straps 146 and 148 can be bolted on opposite sides of curved slot 188 of knuckle 50 in a position so that when lamp cone 40 is rotationally adjusted relative to knuckle 50 for its intended aiming angle, inner and outer straps 146 and 148 would come into abutment with stop strap 142. Thus, the installer of the light system can have a factory-preset stop at the correct aiming angle for each fixture 10. This avoids individual aiming of each fixture when the system is installed at the field. Additionally, it allows easier maintenance. Bolt 174 holding lamp cone 40 to knuckle 50 can be loosened, lamp cone 40 and reflector frame 30 etc. can be swung down. Maintenance can be performed. Without realigning or re-aiming, the worker then only has to swing that reflector frame 30 etc. back up until it hits stop strap 142 and retighten lamp cone 40 to knuckle 50. Lamp cone 40 can be die cast and removably mounted to die cast reflector frame 30 with gaskets or other structure to prevent leaks at that interface of parts.

C. Assembly and Use

In practice, a set of fixtures 10, such as described above, would be used in a sports lighting system customized for a particular sports field. Lighting specifications (usually including light quantity and uniformity minimums; and sometimes glare, spill, and halo light limitations) are usually prepared or known. As is well known in the art, computer software can design the lighting system, including what types of beams and beam shapes from how many fixtures at what locations are needed to meet the specifications. It can generate a report indicating number of fixtures, pole locations, beam types, and aiming angles to meet the design.

As described above, fixtures 10 can be assembled to produce a wide variety of beams and commonly used beam shapes for sports lighting. Using the report, a set of fixtures 10 can be pre-assembled at the factory. The appropriate reflector frame 30 for each beam type called for in the report can be pulled from inventory by the assembly worker. Likewise, the appropriate reflector inserts 120, visor 70, and visor reflective inserts 72 will be pulled from inventory for each fixture according to its position and function in the report.

The assembly worker(s) will mount the appropriate reflective inserts 120 on the pins on each reflector frame 30, and the appropriate visor reflective strips 72 on visor 70 for each fixture 10 (depending on the precise structure of visor 70, mounting straps or brackets may first be secured to visor 70). Glass lens 3, with anti-reflective coatings on both sides installed, is assembled into lens rim 230 with visor 70 attached.

A Z-LAMP™ brand lamp 20 of the appropriate wattage is screwed into socket 154 for each fixture 10 and aligned, through the pin and slot method and/or by correction slots, so that the plane defined by the longitudinal axis of arc tube 12 and the longitudinal axis of lamp 20 is in appropriate alignment relative to reflector frame 30.

Other parts, including those specifically described above, are assembled, to complete each fixture 10 for the given lighting system, including latching the lens 3/visor 70 combination over reflector frame 30, and sealing all holes except for placement of filter in its designated opening. The assembly worker(s) take appropriate measures to avoid any foreign substances from adhering or being inside reflector frame 30 after lens 3/visor 70 is sealingly mounted to it. This includes peeling away the release sheet protective covers on the high reflectivity inserts for reflector frame 30 and visor 70.

Fixtures 10, a pole top with pre-assembled cross arms 7, and poles are shipped to the field to be lighted, along with aiming diagrams, showing how each pre-designed fixture should be aimed relative the field. The entire system, namely poles and bases for the poles, cross arms, fixtures, wiring, ballast boxes, etc. can substantially pre-assembled at the factory (see Musco U.S. Pat. No. 5,600,537, incorporated by reference herein). This pre-assembled system is available from Musco Corporation under the LIGHT STRUCTURE™ brand elevated light fixture, pole and associated components.

At ground level, knuckle plates 60 are attached to cross arms 7 and the appropriate fixture 10 is attached to its appropriate knuckle plate 60 by its knuckle 50 (after wiring for that fixture is connected to pre-wiring in cross arm 7. The knuckle for each fixture 10 is adjusted to match the indicated aiming for that fixture 10 according to the aiming diagram (using the pole as a reference point, as described later). Once aimed, the inner and outer knuckle straps and knuckle stop strap, are bolted in place so that the correct aiming position for the fixture is set. Any pivoting of fixture 10 above or below the reference position for arc tube 12 will result in automatic tilt factor correction movement of yoke 80 for that lamp 20.

The poles are erected vertically. Electrical power from a control cabinet is connected to each ballast box on each pole.

It can therefore be seen that the invention achieves at least all of its stated objectives, aspects, advantages and options. It departs from the state-of-the-art in the ways described. It will be appreciated, however, that the invention can take various forms and embodiments. Variations obvious to those skilled in the art will be included within the invention, which is defined solely by its claims.

What is claimed is:

1. A high intensity lighting fixture for wide area lighting of a target a substantial distance away, comprising:

a. a lamp cone having a size and comprising a body with a longitudinal axis, an interior space, a first end intersecting the longitudinal axis and having a lamp opening through the said first end to the interior space and a mounting interface for a reflector, a second end intersecting the longitudinal axis generally opposite the first end, and a surface along one side intermediate between the first and second ends of the body;

b. a knuckle comprising a lamp cone mounting portion and a structure mounting portion for use in adjustable mounting of the lamp cone to a cross-arm or other suspending structure;

c. a reflector frame having a size substantially larger than the size of the lamp cone, a longitudinal axis, mountable to the first end of the lamp cone, and comprising an outer surface, an inner surface adapted to receive an independent reflecting surface, and a primary opening over which a lens is mountable;

d. a high intensity discharge lamp having a length, an arc tube with a length, and a base mountable through the lamp opening of the first end of and into the lamp cone, the lamp being positionable in the interior of the reflector frame substantially surrounded by the reflecting surface when the lamp base is mounted in the lamp cone such that the length of the high intensity discharge lamp is aligned with the longitudinal axis of the reflector frame and the length of the arc tube is offset from the longitudinal axis of the reflector frame;

e. the lamp cone mounting portion of the knuckle pivotably attachable to the said surface along the one side of the body of the lamp cone.

2. The fixture of claim 1 wherein the knuckle is relatively thin compared to the lamp cone.

3. The fixture of claim 1 further comprising a first sealing member between the knuckle and said surface of the body of the lamp cone and a second sealing member between the reflector frame and the first end of the lamp cone.

4. The fixture of claim 1 further comprising substantially internal pathways in the knuckle for wiring into the lamp cone.

5. The fixture of claim 1 wherein the pivotal attachment of the knuckle to the lamp cone is at or near the center of the said surface of the body of the lamp cone.

6. The fixture of claim 1 wherein the structure mounting portion of the knuckle is pivotably attachable to the said cross-arm or other suspending structure.

7. The fixture of claim 6 wherein the pivoting of the lamp cone mounting portion of the knuckle is about a different pivot axis than the pivoting of the structure mounting portion of the knuckle.

8. A high intensity lighting fixture for wide area lighting of a target a substantial distance away, comprising:

a. a lamp cone having a size and comprising a body with a longitudinal axis, an interior space, a first end intersecting the longitudinal axis with a lamp opening and a mounting interface for a reflector, a second end intersecting the longitudinal axis generally opposite the first end, and a surface along one side intermediate between the first and second ends of the body;

b. a knuckle plate for adjustable mounting to a cross arm or other suspending structure, the knuckle plate having a mounting, interface for an electrical connector;

c. a socket housed at least partially in the lamp cone adapted to receive a lamp, the socket including wiring to power said lamp which terminates in an electrical connector;

d. a knuckle rotationally attachable to the knuckle plate and pivotally attachable to the said surface along one side of the body of the lamp cone, the knuckle including a substantially internal wireway for said wiring.

9. A method for mounting a lighting fixture for wide area lighting of a target a substantial distance away to a cross-arm or other supporting structure in a manner allowing angular adjustment of the fixture relative the cross-arm or other supporting structure, wherein the fixture includes a lamp cone having a longitudinal axis, a first end intersecting the longitudinal axis with a lamp opening through the first end and a mounting interface for a reflector, and a second end intersecting the longitudinal axis generally opposite the first end, and a member having a first pivot attachment to the lamp cone, a second pivot attachment to the cross-arm or other supporting structure, means for indicating angular adjustment relative the cross-arm or other supporting structure, and means for preventing angular adjustment relative the cross-arm or other supporting structure beyond a predetermined orientation comprising:

a. mounting the first pivot attachment of the member to the lamp cone along a first pivot axis which extends in a plane transverse through the lamp cone intermediate between the first and second ends of the lamp cone;

b. mounting the second pivot attachment of the member to the cross-arm or other supporting structure along a second pivot axis which extends in a plane transverse through the cross-arm or other supporting structure, the second pivot axis orthogonal to the first pivot axis;

c. angularly adjusting the lighting fixture relative the cross-arm or other supporting structure via one or more of the pivot axes until a desired orientation is reached, said desired orientation indicated by said indicating means and not to exceed said predetermined orientation.

10. A high intensity lighting fixture comprising:

a. a lamp cone comprising a longitudinal axis, an interior space, a first end intersecting the longitudinal axis having a lamp opening to the interior space through said first end and a mounting interface for a reflector, a second end intersecting the longitudinal axis generally opposite the first end, and a side surface between the first and second ends;

b. a knuckle comprising a lamp cone mounting portion and a knuckle plate mounting portion for use in adjustable mounting of the lamp cone to a cross arm or other suspending structure;

c. a knuckle plate comprising a knuckle plate mounting portion and a structure mounting portion for use in adjustable mounting of the knuckle to a cross arm or other suspending structure;

d. a reflector frame mountable to the first end of the lamp cone and comprising an outer surface, an inner surface adapted to receive a reflecting surface, and a primary opening over which a glass lens is mountable;

e. a high intensity discharge lamp having a base mountable through the lamp opening of the first end of and into the lamp cone and an arc tube, the lamp being positionable in the interior of the reflector frame substantially surrounded by the inner surface when the lamp is mounted in the lamp cone;

f. the lamp cone mounting portion of the knuckle pivotably attachable along the side surface of the lamp cone intermediate between the first and second ends of the lamp cone to provide rotation about a horizontal axis;

g. the knuckle plate mounting portion of the knuckle attachable to the knuckle plate mounting portion of the knuckle plate;

h. the structure mounting portion of the knuckle plate pivotably attachable to the cross arm or other suspending structure to provide rotation about a vertical axis; and i. a substantially internal pathway from the lamp cone to the cross arm or other suspending structure via the knuckle and knuckle plate.

11. The fixture of claim 10 further comprising a first sealing member between the knuckle and the lamp cone and a second sealing member between the reflector frame and the lamp cone.

12. A method for mounting a lighting fixture to a cross arm or other supporting structure in a manner allowing angular adjustment of the fixture relative to the cross arm or other supporting structure in two pivot axes, wherein the fixture includes a lamp cone having a longitudinal axis, a first end intersecting the longitudinal axis and having a lamp opening therein and a mounting interface for a reflector, and a second end intersecting the longitudinal axis generally opposite the first end and a first member having a pivot attachment to the lamp cone and a surface for attachment to a second member, the second member having a pivot attachment to the cross arm or other supporting structure, comprising:

a. mounting the pivot attachment of the first member to the lamp cone along a pivot axis which extends in a plane transverse through the lamp cone intermediate between the first and second ends of the lamp cone;

b. mounting the pivot attachment of the second member to the cross arm or other supporting structure along a pivot axis which extends in a plane transverse through the cross arm or other supporting structure and is perpendicular to the pivot axis through the lamp cone when the longitudinal axis of the lamp cone is perpendicular to the pivot attachment of the second member; and c. bringing into operative connection the first member and second member.

13. The method of claim 12 further comprising one or more structural members which restrict rotation of the lighting fixture about either or both pivot axes to pre-defined ranges.

14. The method of claim 12 wherein the lamp cone has a side surface between the first and second ends and wherein the first member is pivotally attached to the lamp cone at the side surface.

15. A lamp cone for use in a lighting fixture comprising:

a. an elongated body closed at a first end and open at a second end, the second end being generally opposite the first end and having a mounting interface for a reflector;

b. an open space in the elongated body from the first end to the second end such that the elongated body has an outer surface and an inner surface;

c. a lamp socket pivotably attachable to the inner surface of the elongated body along a first pivot axis and positioned in the open space of the elongated body near the closed first end;

d. the elongated body pivotably attachable to a structural component of the lighting fixture along a second pivot axis at a location on the outer surface of the elongated body intermediate between the first and second ends of the elongated body;

e. a mechanism housed at least partially in the elongated body adapted to pivot the lamp socket about the first pivot axis in response to pivoting the elongated body about the second pivot axis.

* * * * *

UNITED STATES PATENT AND TRADEMARK OFFICE

CERTIFICATE OF CORRECTION

PATENT NO. : 8,337,058 B2
APPLICATION NO. : 11/333996
DATED : December 25, 2012
INVENTOR(S) : Myron K. Gordin et al.

It is certified that error appears in the above-identified patent and that said Letters Patent is hereby corrected as shown below:

Col. 7, line 28, DELETE "," after mounting.

Signed and Sealed this
Nineteenth Day of February, 2013

Teresa Stanek Rea
*Acting Director of the United States Patent and Trademark Office*